US009257817B2

(12) United States Patent
Suzuki

(10) Patent No.: US 9,257,817 B2
(45) Date of Patent: Feb. 9, 2016

(54) SPARK PLUG HAVING FUSION ZONE

(75) Inventor: Akira Suzuki, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 137 days.

(21) Appl. No.: 13/880,623

(22) PCT Filed: Nov. 17, 2011

(86) PCT No.: PCT/JP2011/076569
§ 371 (c)(1),
(2), (4) Date: Apr. 19, 2013

(87) PCT Pub. No.: WO2012/067199
PCT Pub. Date: May 24, 2012

(65) Prior Publication Data

US 2013/0214670 A1 Aug. 22, 2013

(30) Foreign Application Priority Data

Nov. 17, 2010 (JP) ..... 2010-256523

(51) Int. Cl.
*H01T 13/20* (2006.01)
*H01T 13/32* (2006.01)
*H01T 21/02* (2006.01)

(52) U.S. Cl.
CPC ..... *H01T 13/20* (2013.01); *H01T 13/32* (2013.01); *H01T 21/02* (2013.01)

(58) Field of Classification Search
CPC ..... H01T 13/32; H01T 13/20; H01T 21/02
USPC ..... 313/141, 144, 138, 118
See application file for complete search history.

(56) References Cited

U.S. PATENT DOCUMENTS 6,215,235 B1 * 4/2001 Osamura ..... 313/141
2002/0003389 A1 1/2002 Ishiguro (Continued)

FOREIGN PATENT DOCUMENTS

CN 1585220 A 2/2005
JP 6-188062 A 7/1994

(Continued)

OTHER PUBLICATIONS

Chinese Office Action dated Apr. 3, 2014 in Chinese Patent Application No. 201180055505.

(Continued)

*Primary Examiner* — Anh Mai
*Assistant Examiner* — Glenn Zimmerman
(74) *Attorney, Agent, or Firm* — Sughrue Mion, PLLC

(57) ABSTRACT

A spark plug (1) includes a center electrode (5), an insulator (2), a metallic shell (3), a ground electrode (27), and a noble metal tip (32) provided on at least one object member of the center electrode and the ground electrode. One end surface of the noble metal tip is joined to the object member via a fusion zone (35). The fusion zone includes a first fusion zone (351) formed through radiation of a laser beam or the like to the boundary between the object member and the one end surface of the noble metal tip along a perimetrical direction of the noble metal tip, and a second fusion zone (352) formed through radiation of the laser beam or the like from the side from which the laser beam or the like has been radiated in forming the first fusion zone, and intersecting with the first fusion zone.

23 Claims, 27 Drawing Sheets

(56) References Cited

U.S. PATENT DOCUMENTS

| | | | | |
|---|---|---|---|---|
| 2002/0017846 | A1 | 2/2002 | Hori | |
| 2002/0050775 | A1* | 5/2002 | Hori | 313/141 |
| 2002/0105254 | A1* | 8/2002 | Hori et al. | 313/141 |
| 2002/0121849 | A1 | 9/2002 | Kanao et al. | |
| 2003/0038577 | A1 | 2/2003 | Hori et al. | |
| 2005/0023949 | A1 | 2/2005 | Hori | |
| 2005/0134160 | A1* | 6/2005 | Yamanaka | 313/144 |
| 2007/0069618 | A1* | 3/2007 | Havard et al. | 313/141 |
| 2007/0128964 | A1 | 6/2007 | Hori | |
| 2009/0033195 | A1* | 2/2009 | Kameda | 313/141 |
| 2011/0193471 | A1 | 8/2011 | Kato | |
| 2011/0198981 | A1* | 8/2011 | Kishimoto | H01T 13/39 313/141 |

FOREIGN PATENT DOCUMENTS

| | | | |
|---|---|---|---|
| JP | 2001-135456 | A | 5/2001 |
| JP | 2002-050448 | A | 2/2002 |
| JP | 2002-093547 | A | 3/2002 |
| JP | 2003-017214 | A | 1/2003 |
| JP | 2003-068421 | A | 3/2003 |
| JP | 2005-050732 | A | 2/2005 |
| WO | 2010/041733 | A1 | 4/2010 |

OTHER PUBLICATIONS

International Search Report for PCT/JP2011/076569 dated Dec. 20, 2011.

* cited by examiner

SPARK PLUG HAVING FUSION ZONE

CROSS REFERENCE TO RELATED APPLICATIONS

This application is a National Stage of International Application No. PCT/JP2011/076569 filed Nov. 17, 2011, claiming priority based on Japanese Patent Application No. 2010-256523 filed Nov. 17, 2010, the contents of all of which are incorporated herein by reference in their entirety.

TECHNICAL FIELD

The present invention relates to a spark plug for use in an internal combustion engine, etc.

BACKGROUND ART

A spark plug for use in a combustion apparatus, such as an internal combustion engine, includes, for example, a center electrode extending in the direction of an axis, an insulator provided around the center electrode, a tubular metallic shell attached to the outside of the insulator, and a ground electrode whose proximal end portion is joined to a forward end portion of the metallic shell. The ground electrode is bent at its substantially intermediate portion in such a manner that its distal end portion faces a forward end portion of the center electrode, thereby forming a spark discharge gap between the forward end portion of the center electrode and a distal end portion of the ground electrode.

In recent years, there has been known a technique for improving erosion resistance by providing a noble metal tip at a forward end portion of the center electrode and/or a distal end portion of the ground electrode in a region adapted to form the spark discharge gap. In joining the noble metal tip to the ground electrode or the like, generally, laser welding by means of a YAG laser is used (refer to, for example, Patent Document 1). Specifically, a laser beam is intermittently radiated to the circumference or perimeter of the boundary between the noble metal tip and the ground electrode or the like, thereby joining the noble metal tip to the ground electrode or the like through formation of a fusion zone where components of the members are fused together.

PRIOR ART DOCUMENT

Patent Document

Patent Document 1: Japanese Patent Application Laid-Open (kokai) No. 2003-17214

SUMMARY OF THE INVENTION

Problems to be Solved by the Invention

However, in order to make the fusion zone penetrate deep into the ground electrode or the like so as to maintain sufficient joining strength, increasing radiation energy is required; however, in the case of use of YAG laser, this leads to the fusion zone having a relatively large volume. Accordingly, the fusion zone may be exposed to the spark discharge gap, or the noble metal tip may be melted in a relatively large amount in the course of forming the fusion zone, resulting in the noble metal tip becoming greatly thin. As a result, an action or effect of improving erosion resistance through provision of the noble metal tip may fail to be sufficiently exhibited.

In view of this, the inventor of the present invention carried out extensive studies and found the following: by use of a high-energy laser beam, such as a fiber laser beam, in place of a YAG laser beam, while a sufficiently wide weld zone is formed between the noble metal tip and the ground electrode or the like, the weld zone can have a relatively small volume, whereby the effect of improving erosion resistance is sufficiently exhibited.

However, the inventor of the present invention carried out further studies and found the following: when a fiber laser beam or the like is used, the fusion zone becomes globally thin; thus, the fusion zone encounters difficulty in absorbing a stress difference between the noble metal tip and the ground electrode or the like associated with thermal expansion, and in turn, separation of the noble metal tip could arise.

The present invention has been conceived in view of the above circumstances, and an object of the invention is to provide a spark plug which can effectively restrain the separation of a noble metal tip, while sufficiently exhibiting the effect of improving erosion resistance through provision of the noble metal tip.

Means for Solving the Problems

Configurations suitable for solving the above problems will next be described in itemized form. If needed, actions and effects peculiar to the configurations will be described additionally.

Configuration 1. A spark plug of the present configuration comprises:

a rodlike center electrode extending in a direction of an axis;

a tubular insulator provided around the center electrode;

a tubular metallic shell provided around the insulator;

a ground electrode whose proximal end is welded to the metallic shell and whose distal end faces the center electrode; and a columnar noble metal tip formed from a noble metal alloy and provided on at least one object member of the center electrode and the ground electrode.

One end surface of the noble metal tip is joined to the object member via a fusion zone formed through radiation of a laser beam or an electron beam from a side toward a side surface of the noble metal tip.

The spark plug is characterized in that the fusion zone comprises:

a first fusion zone formed through radiation of the laser beam or the electron beam to a boundary between the object member and the one end surface of the noble metal tip along a perimetrical direction of the noble metal tip, and a second fusion zone formed through radiation of the laser beam or the electron beam from the side from which the laser beam or the electron beam has been radiated in forming the first fusion zone, and intersecting with the first fusion zone.

The first fusion zone and the second fusion zone may be formed continuously or intermittently.

According to the above configuration 1, in addition to the first fusion zone formed between the noble metal tip and the object member (the ground electrode or the center electrode), the second fusion zone is formed in such a manner as to intersect with the first fusion zone. That is, by virtue of the presence of the second fusion zone, at least a portion of the fusion zone is thicker than the first fusion zone. Therefore, the thick portion, which is superior to the first fusion zone in the capability of absorbing a stress difference, can effectively absorb an excess stress difference between the noble metal tip and the object member associated with thermal expansion which the first fusion zone has failed to absorb.

Furthermore, a stress difference which arises along a boundary surface between the fusion zone and the noble metal tip or between the fusion zone and the object member may cause movement of the fusion zone in relation to the object member or the noble metal tip, potentially resulting in separation of the noble metal tip; however, the provision of the second fusion zone renders the boundary surface partially protrusive. Therefore, the protrusion functions as, so to speak, a wedge, whereby a relative movement of the fusion zone along the boundary surface can be more reliably restrained.

Also, according to the above configuration 1, as compared with the case where the first fusion zone is merely rendered thick, the volume of the fusion zone can be sufficiently small. Thus, a portion of the noble metal tip which fuses in the joining process can be reduced, whereby there can be more reliably prevented the exposure of the fusion zone to a spark discharge gap and a situation in which the noble metal tip becomes excessively thin.

As mentioned above, according to the above configuration 1, while the effect of improving erosion resistance through provision of the noble metal tip is sufficiently exhibited, the effect of effectively absorbing a stress difference and the effect of preventing movement of the fusion zone through provision of the second fusion zone can achieve synergy, whereby the separation of the noble metal tip can be quite effectively prevented.

Configuration 2. A spark plug of the present configuration is characterized in that, in the above configuration 1, the noble metal tip is joined to at least an inner side surface of the ground electrode, and the fusion zone is formed through radiation of the laser beam or the electron beam from a side toward at least one of a distal end surface and opposite side surfaces of the ground electrode, and when the noble metal tip and the fusion zone are viewed from the side from which the laser beam or the electron beam has been radiated to the surface of the ground electrode, assuming that a portion of the fusion zone located between the ground electrode and the noble metal tip is equally divided into three segmental regions along a width direction of the noble metal tip, the first fusion zone and the second fusion zone are in contact with each other in at least a center one of the three segmental regions.

The expression "when . . . viewed from the side from which the laser beam or the electron beam has been radiated to the surface of the ground electrode" can be said to mean "when . . . viewed from a direction orthogonal to the side surface of the ground electrode associated with the side from which the laser beam or the electron beam has been radiated."

According to the above configuration 2, since the second fusion zone is provided at the center of the fusion zone, an excess stress difference which the first fusion zone fails to absorb is more reliably applied to the thick portion (where the second fusion zone exists) of the fusion zone, the thick portion being superior in the capability of absorbing a stress difference. As a result, a stress difference can be more effectively absorbed, and thus, the separation of the noble metal tip can be more reliably prevented.

In order to further enhance the effect of absorbing a stress difference by the fusion zone, desirably, as viewed from a side from which the laser beam or the like is radiated, the first fusion zone is formed along the entire width of the noble metal tip.

Configuration 3. A spark plug of the present configuration is characterized in that, in the above configuration 1 or 2, the noble metal tip is joined to at least the ground electrode, and the fusion zone is formed through radiation of the laser beam or the electron beam from a side toward at least one of a distal end surface and opposite side surfaces of the ground electrode, and when the noble metal tip and the fusion zone are viewed from the side from which the laser beam or the electron beam has been radiated to the surface of the ground electrode, assuming that a portion of the fusion zone located between the ground electrode and the noble metal tip is equally divided into three segmental regions along a width direction of the noble metal tip, the first fusion zone and the second fusion zone are in contact with each other in at least opposite end ones of the three segmental regions.

According to the above configuration 3, as viewed from the side from which the laser beam or the like has been radiated, the second fusion zones are located at opposite end portions of the fusion zone. Thus, an excess stress difference which the first fusion zone fails to absorb is evenly applied to the thick portions of the fusion zone, whereby a stress difference can be more effectively absorbed. Also, the wedge function is more strongly exhibited, whereby movement of the fusion zone can be more reliably restrained. As a result, the effect of preventing separation of the noble metal tip can be further improved.

Configuration 4. A spark plug of the present configuration is characterized in that, in any one of the above configurations 1 to 3, the noble metal tip is joined to at least the ground electrode, and through radiation of the laser beam or the electron beam from a side toward each of a distal end surface and opposite side surfaces of the ground electrode, the second fusion zone is formed on each of the distal end surface and the opposite side surfaces of the ground electrode.

According to the above configuration 4, at least three second fusion zones are provided corresponding to the distal end surface and the opposite side surfaces of the ground electrode, whereby the effect of absorbing a stress difference or the like effect can be further enhanced.

Configuration 5. A spark plug of the present configuration is characterized in that, in any one of the above configurations 1 to 4, the noble metal tip is joined to at least the ground electrode;

a plurality of the second fusion zones are formed; and as viewed from a side toward the other end surface of the noble metal tip, the second fusion zones are formed at positions located symmetrically with respect to a center axis of the noble metal tip.

Notably, the concept of the term "symmetrical" encompasses not only the case where the second fusion zones are formed at strictly symmetrical positions with respect to the center axis, but also the case where the second fusion zones are formed at positions slightly deviated from the symmetrical positions. Therefore, for example, as viewed from a side toward the other end surface of the noble metal tip, when the center of the outer surface (the surface irradiated with the laser beam or the like) of one second fusion zone is imaginarily moved to its symmetrical position with respect to the center axis, the center of the outer surface of the other second fusion zone may be deviated slightly (by, e.g., about 0.1 mm) from the moved center.

According to the above configuration 5, since the second fusion zones (thick portions of the fusion zone) are located at symmetrical positions with respect to the center axis of the noble metal tip, the thick portions can evenly absorb a stress difference. Therefore, the fusion zone can more reliably absorb a stress difference, whereby separation resistance of the noble metal tip can be further improved.

Configuration 6. A spark plug of the present configuration is characterized in that, in any one of the above configurations 1 to 5, the noble metal tip is joined to at least the ground electrode;

a plurality of the second fusion zones are formed; and as viewed from a side toward the other end surface of the noble metal tip, the second fusion zones are formed at positions located symmetrically with respect to a straight line (baseline) which extends along a longitudinal direction of the ground electrode and passes through a center axis of the noble metal tip.

Notably, the concept of the term "symmetrical" encompasses not only the case where the second fusion zones are formed at strictly symmetrical positions with respect to the baseline, but also the case where the second fusion zones are formed at positions slightly deviated from the symmetrical positions. Therefore, for example, as viewed from a side toward the other end surface of the noble metal tip, when the center of the outer surface of one second fusion zone is imaginarily moved to its symmetrical position with respect to the baseline, the center of the outer surface of the other second fusion zone may be deviated slightly (by, e.g., about 0.1 mm) from the moved center.

According to the above configuration 6, since the second fusion zones (thick portions of the fusion zone) are located at symmetrical positions with respect to the baseline, the thick portions can evenly absorb a stress difference, whereby separation resistance of the noble metal tip can be further improved.

Configuration 7. A spark plug of the present configuration is characterized in that, in any one of the above configurations 1 to 5, the noble metal tip is joined to at least the ground electrode;

a plurality of the second fusion zones are formed; and as viewed from a side toward the other end surface of the noble metal tip, the second fusion zones are formed at positions located symmetrically with respect to a straight line (orthogonal baseline) which extends along a direction orthogonal to a longitudinal direction of the ground electrode and passes through a center axis of the noble metal tip.

Notably, the concept of the term "symmetrical" encompasses not only the case where the second fusion zones are formed at strictly symmetrical positions with respect to the orthogonal baseline, but also the case where the second fusion zones are formed at positions slightly deviated from the symmetrical positions. Therefore, for example, as viewed from a side toward the other end surface of the noble metal tip, when the center of the outer surface of one second fusion zone is imaginarily moved to its symmetrical position with respect to the orthogonal baseline, the center of the outer surface of the other second fusion zone may be deviated slightly (by, e.g., about 0.1 mm) from the moved center.

According to the above configuration 7, the thick portions can evenly absorb a stress difference, whereby separation resistance of the noble metal tip can be further improved.

Configuration 8. A spark plug of the present configuration is characterized in that, in the above configuration 1, the noble metal tip is joined to at least the center electrode;

the first fusion zone is formed along the entire circumference of the noble metal tip;

a plurality of the second fusion zones are formed; and as viewed from a side toward the other end surface of the noble metal tip, the second fusion zones are formed at positions located symmetrically with respect to a center axis of the noble metal tip.

Notably, the concept of the expression "the second fusion zones are formed at positions located symmetrically with respect to a center axis of the noble metal tip" encompasses the case where "a plurality of the second fusion zones are provided at equal intervals along the circumferential direction of the noble metal tip."

The concept of the term "symmetrical" encompasses not only the case where the second fusion zones are formed at strictly symmetrical positions, but also the case where the second fusion zones are formed at positions slightly deviated from the symmetrical positions. Therefore, when the second fusion zones are formed at strictly symmetrical positions with respect to the center axis, as viewed from a side toward the other end surface of the noble metal tip, an angle of 360°/n (n is the number of the second fusion zones) is formed between a straight line which connects the center axis and the center of the outer surface of one second fusion zone, and a straight line which connects the center axis and the center of the outer surface of the second fusion zone adjacent to the one second fusion zone; however, the second fusion zones may be formed such that the angle deviates slightly (by, e.g., about 10°) from 360°/n.

According to the above configuration 8, since the first fusion zone is formed along the entire circumference of the noble metal tip, the effect of absorbing a stress difference by the first fusion zone can be enhanced. Also, as viewed from a side toward the other end surface of the noble metal tip, since the second fusion zones are formed at symmetrical positions with respect to the center axis of the noble metal tip, thick portions of the fusion zone implemented by the second fusion zones can evenly absorb a stress difference. As a result, coupled with improvement in the effect of absorbing a stress difference by the first fusion zone, the separation of the noble metal tip can be quite effectively prevented.

Configuration 9. A spark plug of the present configuration is characterized in that, in the above configuration 8, assuming that an outer circumferential surface of the fusion zone is equally divided into three segmental regions along a circumferential direction thereof, the second fusion zone exists in each of the three segmental regions.

According to the above configuration 9, when the fusion zone as viewed from a side toward the other end surface of the noble metal tip is equally divided into three divisions about the center axis of the noble metal tip, the second fusion zone exists in each of the three divisions of the fusion zone. Therefore, a stress difference can be more reliably absorbed, whereby separation resistance can be further improved.

Configuration 10. A spark plug of the present configuration is characterized in that, in any one of the above configurations 1 to 9, the first fusion zone has a maximum thickness of 0.3 mm or less along a center axis of the noble metal tip.

According to the above configuration 10, the maximum thickness of the first fusion zone along the center axis of the noble metal tip is specified as 0.3 mm or less; i.e., the first fusion zone is formed very thin. Therefore, the volume of the noble metal tip can be further increased, whereby erosion resistance can be further improved.

Meanwhile, when the first fusion zone is formed thin, deterioration in separation resistance is of concern; however, the concern can be erased through provision of the second fusion zone(s). In other words, the provision of the second fusion zone(s) is particularly effective in the case where the maximum thickness of the first fusion is specified as 0.3 mm or less.

Configuration 11. A spark plug of the present configuration is characterized in that, in any one of the above configurations 1 to 10, a length of an outer surface of the second fusion zone along a perimetrical direction of the noble metal tip is 30% or more of a length of an outer surface of the first fusion zone along the perimetrical direction of the noble metal tip.

Notably, "the outer surface of the first fusion zone and the outer surface of the second fusion zone" are surfaces irradiated with the laser beam or the electron beam. Also, in the case where a plurality of the first fusion zones and a plurality of the second fusion zones are provided, "the length of the outer surface of the first fusion zone and the length of the outer surface of the second fusion zone" mean the total length of the outer surfaces of the first fusion zones along the perimetrical direction of the noble metal tip and the total length of the outer surfaces of the second fusion zones along the perimetrical direction of the noble metal tip.

According to the above configuration 11, the second fusion zone is formed over a relatively wide range of a boundary region between a perimetrical portion of the noble metal tip and the object member (the center electrode or the ground electrode), the boundary region being where a particularly large stress difference arises in association with thermal expansion. Therefore, a stress difference associated with thermal expansion can be more reliably absorbed, whereby separation resistance can be further improved.

Configuration 12. A spark plug of the present configuration is characterized in that, in any one of the above configurations 1 to 10, a length of an outer surface of the second fusion zone along a perimetrical direction of the noble metal tip is 50% or more of a length of an outer surface of the first fusion zone along the perimetrical direction of the noble metal tip.

According to the above configuration 12, a stress difference can be more effectively absorbed, whereby separation resistance can be further improved.

Configuration 13. A spark plug of the present configuration is characterized in that, in any one of the above configurations 1 to 10, a length of an outer surface of the second fusion zone along a perimetrical direction of the noble metal tip is 70% or more of a length of an outer surface of the first fusion zone along the perimetrical direction of the noble metal tip.

According to the above configuration 13, a stress difference can be far more effectively absorbed, whereby separation resistance can be far more greatly improved.

Configuration 14. A spark plug of the present configuration is characterized in that, in any one of the above configurations 1 to 13, as viewed on a plane of projection which is orthogonal to a center axis of the noble metal tip and on which the noble metal tip and the fusion zone are projected along the center axis, a projected overlap region of the noble metal tip and the fusion zone accounts for 50% or more of a projected region of the noble metal tip.

According to the above configuration 14, half or more of one end surface (bottom surface) of the noble metal tip is joined to the object member (the ground electrode or the center electrode); thus, a sufficiently wide fusion zone intervenes between the object member and the one end surface of the noble metal tip. Therefore, sufficient strength of joining the noble metal tip to the object member can be ensured, so that the actions and effects of the above configuration 1, etc., are more reliably yielded.

Configuration 15. A spark plug of the present configuration comprises:

a rodlike center electrode extending in a direction of an axis;

a tubular insulator provided around the center electrode;

a tubular metallic shell provided around the insulator;

a ground electrode whose proximal end is welded to the metallic shell and whose distal end faces the center electrode; and a columnar noble metal tip formed from a noble metal alloy and provided on at least one object member of the center electrode and the ground electrode.

The spark plug is characterized in that:

one end surface of the noble metal tip is joined to the object member via a fusion zone which is formed by radiating a laser beam or an electron beam from a side toward a side surface of the noble metal tip in such a manner as to intersect with a boundary between the noble metal tip and the object member, and the fusion zone comprises a plurality of segmental fusion zones formed across the boundary between the object member and the one end surface of the noble metal tip.

According to the above configuration 15, the fusion zone comprises a plurality of the segmental fusion zones formed across the boundary between the object member (the center electrode or the ground electrode) and the one end surface of the noble metal tip. That is, a plurality of the segmental fusion zones penetrate into both of the object member and the noble metal tip. Therefore, the segmental fusion zones function as, so to speak, wedges, whereby there can be restrained movement of the noble metal tip in relation to the object member associated with a stress difference which arises between the noble metal tip and the object member. As a result, strength of joining the noble metal tip to the object member can be improved, whereby excellent separation resistance can be implemented.

Configuration 16. A spark plug of the present configuration is characterized in that, in the above configuration 15, the noble metal tip is joined to at least an inner side surface of the ground electrode, and the fusion zone is formed through radiation of the laser beam or the electron beam from a side toward at least one of a distal end surface and opposite side surfaces of the ground electrode, and as viewed from the side from which the laser beam or the electron beam has been radiated, a portion of an outer surface of the fusion zone located on a boundary between the noble metal tip and the ground electrode has a length which is 30% or more of a length of the boundary.

According to the above configuration 16, the segmental fusion zones are formed over a relatively wide range of a boundary region between the ground electrode and a perimetrical portion of the noble metal tip, the boundary region being where a particularly large stress difference arises. Therefore, the segmental fusion zones can more effectively exhibit the wedge function, whereby separation resistance can be further improved.

Configuration 17. A spark plug of the present configuration is characterized in that, in the above configuration 15, the noble metal tip is joined to at least an inner side surface of the ground electrode, and the fusion zone is formed through radiation of the laser beam or the electron beam from a side toward at least one of a distal end surface and opposite side surfaces of the ground electrode, and as viewed from the side from which the laser beam or the electron beam has been radiated, a portion of an outer surface of the fusion zone located on a boundary between the noble metal tip and the ground electrode has a length which is 50% or more of a length of the boundary.

According to the above configuration 17, the segmental fusion zones can far more effectively exhibit the wedge function, whereby separation resistance can be far more greatly improved.

Configuration 18. A spark plug of the present configuration is characterized in that, in any one of the above configurations 15 to 17, the noble metal tip is joined to at least the ground electrode, and through radiation of the laser beam or the electron beam from a side toward each of a distal end surface and opposite side surfaces of the ground electrode, the segmental fusion zones are formed on the distal end surface and the opposite side surfaces of the ground electrode.

According to the above configuration 18, since the segmental fusion zones are provided corresponding to the distal end surface and the opposite side surfaces of the ground electrode, the segmental fusion zones exhibit the wedge function in a wide range of the boundary surface between the noble metal tip and the ground electrode. As a result, strength of joining the noble metal tip can be further enhanced, whereby quite excellent separation resistance can be implemented.

Configuration 19. A spark plug of the present configuration is characterized in that, in any one of the above configurations 15 to 18, the noble metal tip is joined to at least the ground electrode, and as viewed from a side toward the other end surface of the noble metal tip, the segmental fusion zones are formed at positions located symmetrically with respect to a center axis of the noble metal tip.

Notably, the concept of the expression "the segmental fusion zones are formed at positions located symmetrically with respect to the center axis of the noble metal tip" encompasses the case where "a plurality of the fusion zones are provided at equal intervals along a perimetrical direction."

Also, the concept of the term "symmetrical" encompasses not only the case where the segmental fusion zones are formed at strictly symmetrical positions with respect to the center axis, but also the case where the segmental fusion zones are formed at positions slightly deviated from the symmetrical positions. Therefore, for example, as viewed from a side toward the other end surface of the noble metal tip, when the center of the outer surface (the surface irradiated with the laser beam or the like) of one segmental fusion zone is imaginarily moved to its symmetrical position with respect to the center axis, the center of the outer surface of the other segmental fusion zone may be deviated slightly (by, e.g., about 0.1 mm) from the moved center.

According to the above configuration 19, as viewed from a side toward the other end surface of the noble metal tip, the segmental fusion zones are formed at symmetrical positions with respect to the center axis of the noble metal tip. That is, the segmental fusion zones are disposed in a well balanced manner on the boundary surface between the noble metal tip and the ground electrode. Therefore, the segmental fusion zones more effectively exhibit the wedge function, whereby separation resistance can be further enhanced.

Configuration 20. A spark plug of the present configuration is characterized in that, in any one of the above configurations 15 to 19, the noble metal tip is joined to at least the ground electrode, and as viewed from a side toward the other end surface of the noble metal tip, the segmental fusion zones are formed at positions located symmetrically with respect to a straight line which extends along a longitudinal direction of the ground electrode and passes through a center axis of the noble metal tip.

Notably, the concept of the term "symmetrical" encompasses not only the case where the segmental fusion zones are formed at strictly symmetrical positions with respect to the straight line which extends along the longitudinal direction of the ground electrode and passes through the center axis of the noble metal tip, but also the case where the segmental fusion zones are formed at positions slightly deviated from the symmetrical positions. Therefore, for example, as viewed from a side toward the other end surface of the noble metal tip, when the center of the outer surface of one segmental fusion zone is imaginarily moved to its symmetrical position with respect to the straight line, the center of the outer surface of the other segmental fusion zone may be deviated slightly (by, e.g., about 0.1 mm) from the moved center.

According to the above configuration 20, similar to the above configuration 19, the segmental fusion zones are disposed in a well balanced manner on the boundary surface between the noble metal tip and the ground electrode. Therefore, the segmental fusion zones more effectively exhibit the wedge function, whereby separation resistance can be further enhanced.

Configuration 21. A spark plug of the present configuration is characterized in that, in any one of the above configurations 15 to 19, the noble metal tip is joined to at least the ground electrode, and as viewed from a side toward the other end surface of the noble metal tip, the segmental fusion zones are formed at positions located symmetrically with respect to a straight line which extends along a direction orthogonal to a longitudinal direction of the ground electrode and passes through a center axis of the noble metal tip.

Notably, the concept of the term "symmetrical" encompasses not only the case where the segmental fusion zones are formed at strictly symmetrical positions with respect to the straight line which extends along a direction orthogonal to the longitudinal direction of the ground electrode and passes through the center axis of the noble metal tip, but also the case where the segmental fusion zones are formed at positions slightly deviated from the symmetrical positions. Therefore, for example, as viewed from a side toward the other end surface of the noble metal tip, when the center of the outer surface of one segmental fusion zone is imaginarily moved to its symmetrical position with respect to the straight line, the center of the outer surface of the other segmental fusion zone may be deviated slightly (by, e.g., about 0.1 mm) from the moved center.

According to the above configuration 21, since the segmental fusion zones are disposed in a well balanced manner on the boundary surface between the noble metal tip and the ground electrode, the segmental fusion zones more effectively exhibit the wedge function, whereby separation resistance can be further improved.

Configuration 22. A spark plug of the present configuration is characterized in that, in any one of the above configurations 15 to 21, the noble metal tip is joined to at least the center electrode), and a portion of an outer surface of the fusion zone located on a boundary between the noble metal tip and the center electrode has a length which is 30% or more of a length of the boundary.

According to the above configuration 22, the segmental fusion zones are formed over a relatively wide range of a boundary region between the center electrode and a circumferential portion of the noble metal tip, the boundary region being where a particularly large stress difference arises. Therefore, the segmental fusion zones can more effectively exhibit the wedge function, whereby separation resistance can be further improved.

Configuration 23. A spark plug of the present configuration is characterized in that, in any one of the above configurations 15 to 21, the noble metal tip is joined to at least the center electrode, and a portion of an outer surface of the fusion zone located on a boundary between the noble metal tip and the center electrode has a length which is 50% or more of a length of the boundary.

According to the above configuration 23, the segmental fusion zones can far more effectively exhibit the wedge function, whereby separation resistance can be far more greatly improved.

BRIEF DESCRIPTION OF THE DRAWINGS

FIG. 44(*b*) Sectional view showing the fusion zone as viewed at a radially inner position.

MODES FOR CARRYING OUT THE INVENTION

Embodiments of the present invention will next be described with reference to the drawings.

First Embodiment

Figure 1:
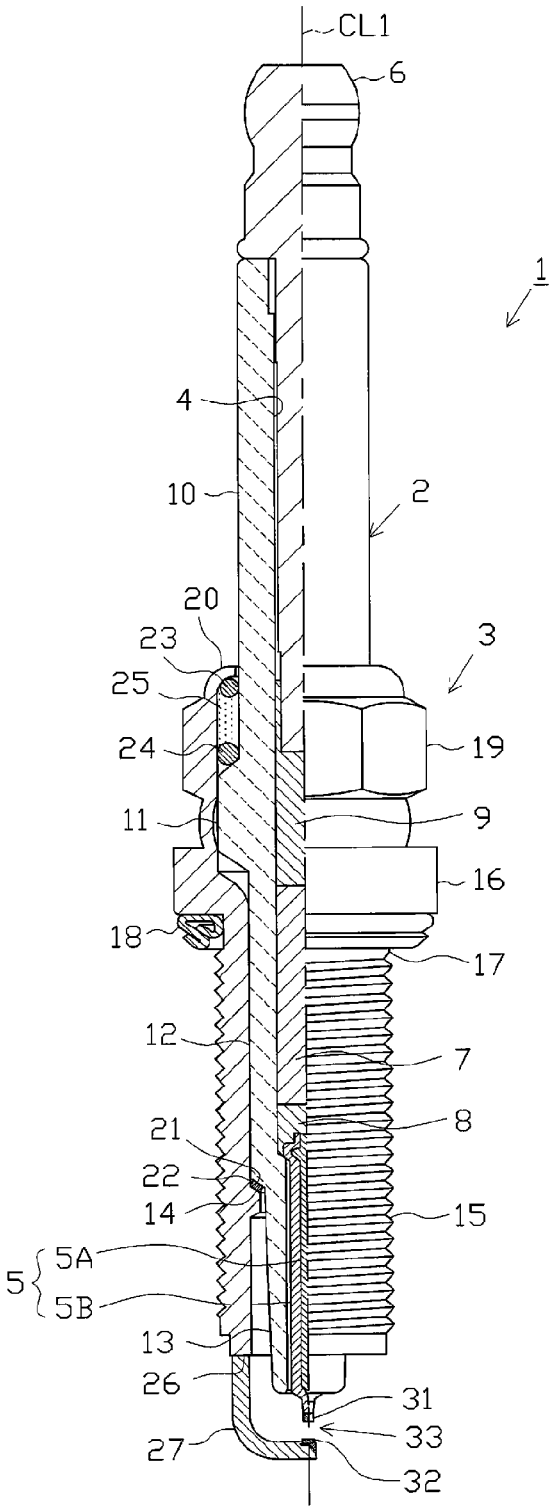
FIG. 1 Partially cutaway front view showing the configuration of a spark plug.

FIG. 1 is a partially cutaway front view showing a spark plug 1. In the following description, the direction of an axis CL1 of the spark plug 1 in FIG. 1 is referred to as the vertical direction, and the lower side of the spark plug 1 in FIG. 1 is referred to as the forward side of the spark plug 1, and the upper side as the rear side of the spark plug 1.

The spark plug 1 includes a ceramic insulator 2, which corresponds to the tubular insulator in the present invention, and a tubular metallic shell 3, which holds the ceramic insulator 2.

The ceramic insulator 2 is formed from alumina or the like by firing, as well known in the art. The ceramic insulator 2 externally includes a rear trunk portion 10 formed on the rear side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. Additionally, the large-diameter portion 11, the intermediate trunk portion 12, and most of the leg portion 13 of the ceramic insulator 2 are accommodated in the metallic shell 3. A tapered, stepped portion 14 is formed at a connection portion between the leg portion 13 and the intermediate trunk portion 12, and the ceramic insulator 2 is seated on the metallic shell 3 via the stepped portion 14.

Furthermore, the ceramic insulator 2 has an axial bore 4 extending therethrough along the axis CL1, and a center electrode 5 is fixedly inserted into a forward end portion of the axial bore 4. The center electrode 5 includes an inner layer 5A of copper or a copper alloy, which has excellent thermal conductivity, and an outer layer 5B of an Ni alloy which contains nickel (Ni) as a main component. Additionally, the center electrode 5 assumes a rodlike (circular columnar) shape as a whole; has the flat forward end surface; and projects from the forward end of the ceramic insulator 2. Also, a circular columnar noble metal member 31 of a predetermined noble metal alloy (e.g., a platinum alloy or an iridium alloy) is provided at a forward end portion of the center electrode 5.

Also, a terminal electrode 6 is fixedly inserted into the rear side of the axial bore 4 in such a manner as to project from the rear end of the ceramic insulator 2.

Furthermore, a circular columnar resistor 7 is disposed within the axial bore 4 between the center electrode 5 and the terminal electrode 6. Opposite end portions of the resistor 7 are electrically connected to the center electrode 5 and the terminal electrode 6 via electrically conductive glass seal layers 8 and 9, respectively.

Additionally, the metallic shell 3 is formed into a tubular shape from a low-carbon steel or the like and has a threaded portion (externally threaded portion) 15 on its outer circumferential surface, and the threaded portion 15 is adapted to mount the spark plug 1 into a mounting hole of a combustion apparatus (e.g., an internal combustion engine or a fuel cell reformer). The metallic shell 3 has a seat portion 16 formed on its outer circumferential surface and located rearward of the threaded portion 15. A ring-like gasket 18 is fitted to a screw neck 17 located at the rear end of the threaded portion 15. Furthermore, the metallic shell 3 also has a tool engagement portion 19 provided near its rear end. The tool engagement portion 19 has a hexagonal cross section and allows a tool such as a wrench to be engaged therewith when the metallic shell 3 is to be mounted to the combustion apparatus. The metallic shell 3 also has a crimp portion 20 provided at its rear end portion and adapted to hold the ceramic insulator 2.

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed to the metallic shell 3. An annular sheet packing 22 intervenes between the stepped portions 14 and 21 of the ceramic insulator 2 and the metallic shell 3, respectively. This retains gastightness of a combustion chamber and prevents leakage of fuel gas to the exterior of the spark plug 1 through a clearance between the inner circumferential surface of the metallic shell 3 and the leg portion 13 of the ceramic insulator 2, the leg portion 13 being exposed to the combustion chamber.

Furthermore, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

Figure 2:
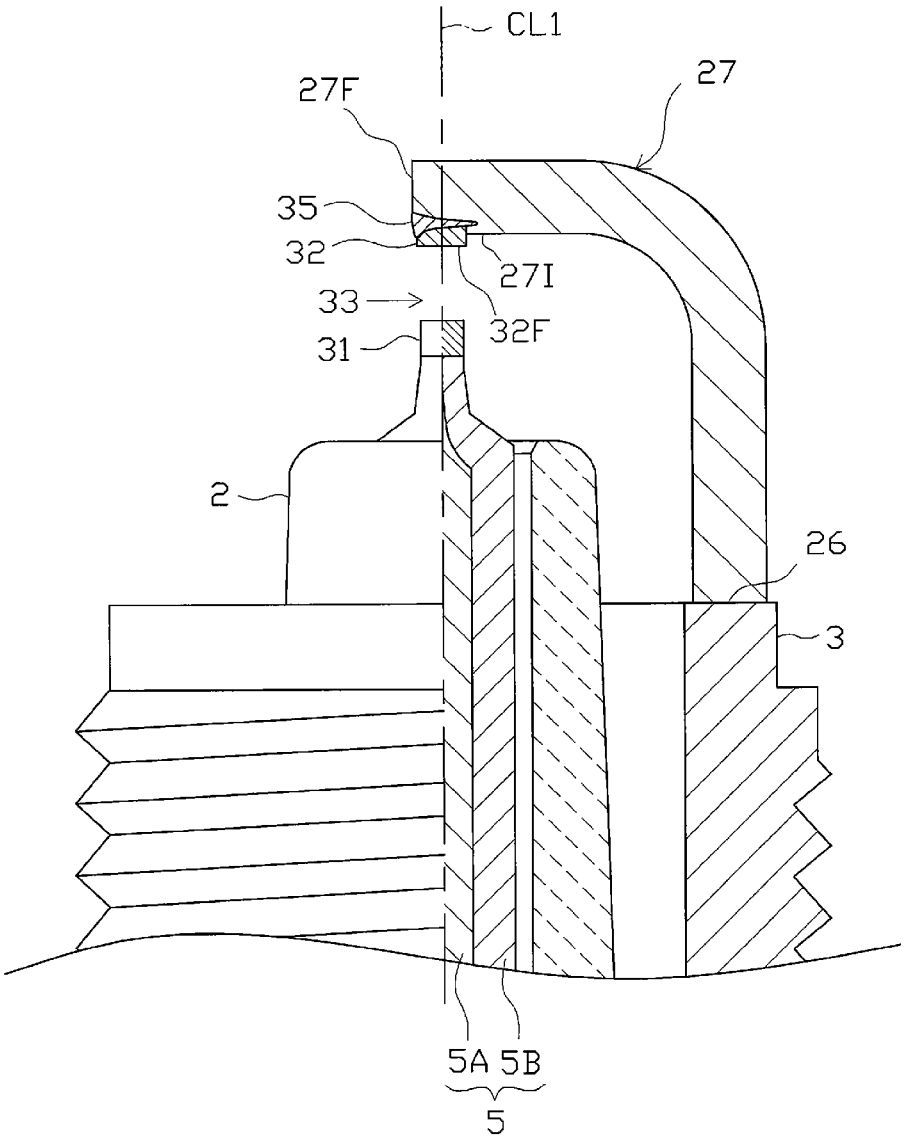
FIG. 2 Partially cutaway, enlarged, front view showing the configuration of a forward end portion of the spark plug.

As shown in FIG. 2, a ground electrode 27 is provided at a forward end portion 26 of the metallic shell 3. The ground electrode 27 is welded at its proximal end portion to the metallic shell 3 and is bent at its intermediate portion such that its distal end portion faces a forward end portion (the noble metal member 31) of the center electrode 5. The ground electrode 27 is formed from an Ni alloy which contains Ni as a main component (e.g., an alloy which contains Ni as a main component, as well as at least one of silicon, aluminum, and rare earth elements).

Furthermore, one end surface of a noble metal tip 32 resembling in shape to a square column (square parallelepiped) is joined to a surface (inner side surface) 27I of the ground electrode 27 located on a side toward the center electrode 5 at a portion which faces the forward end surface of the noble metal member 31 (in the present embodiment, the ground electrode 27 corresponds to the "object member" in the present invention). The noble metal tip 32 is formed from a predetermined noble metal alloy (for example, a noble metal alloy which contains at least one of iridium, platinum, rhodium, ruthenium, palladium, and rhenium). In the present embodiment, in order to keep a lid on manufacturing cost, the noble metal tip 32 is formed relatively thin (e.g., 0.2 mm to 0.6 mm), whereas, in order to improve erosion resistance, the other end surface (discharge surface) 32F of the noble metal tip 32 which faces the noble metal member 31 has a relatively large area (e.g., 0.6 $mm^2$ or more).

Additionally, a spark discharge gap 33 is formed between the noble metal member 31 and the other end surface 32F of the noble metal tip 32, and spark discharges are performed across the spark discharge gap 33 along the direction of the axis CL1.

Figure 3:
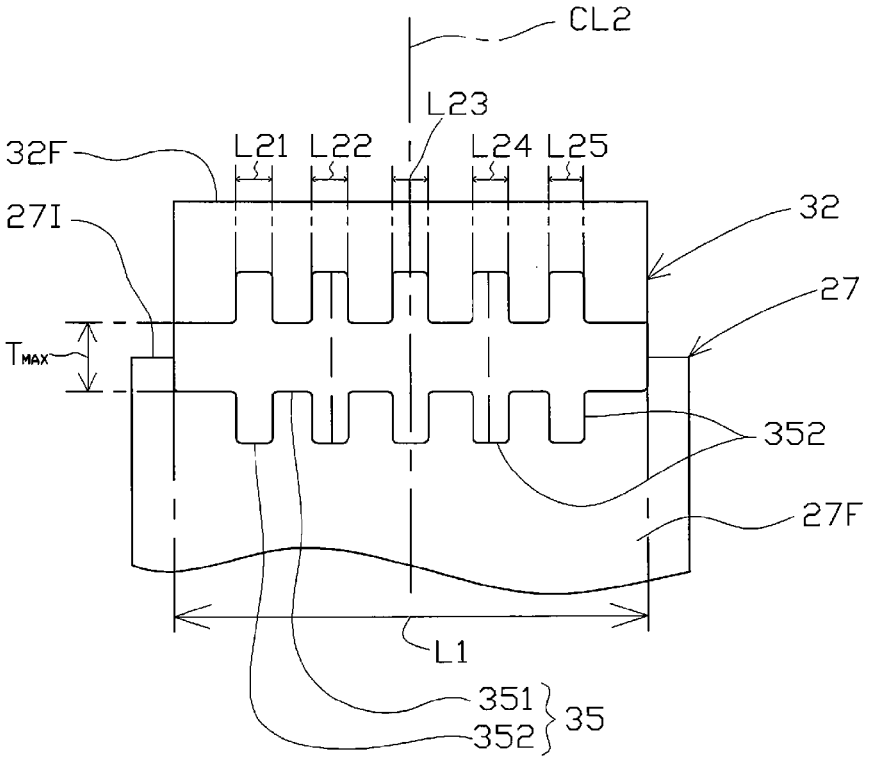
FIG. 3 Fragmentary, enlarged, side view showing the configuration of a fusion zone.

Additionally, the noble metal tip 32 is joined at its one end surface to the ground electrode 27 via a fusion zone 35 formed through radiation of a laser beam or an electron beam from a side toward its side surface. The fusion zone 35 is formed through fusion of a metal used to form the noble metal tip 32 and a metal used to form the ground electrode 27 and includes, as shown in FIG. 3 (FIG. 3 is an enlarged side view as viewed from a side toward a distal end surface 27F of the ground electrode 27), a first fusion zone 351 and a second fusion zone 352.

The first fusion zone 351 is formed by continuously radiating a laser beam or an electron beam from a side toward the distal end surface 27F of the ground electrode 27 to the boundary region between the ground electrode 27 and the one end surface of the noble metal tip 32 along the perimetrical direction of the noble metal tip 32. The first fusion zone 351 has a flat shape extending substantially along the other end surface 32F of the noble metal tip 32. In the present embodiment, as viewed from the side from which the laser beam or the like has been radiated to the surface (the distal end surface 27F) of the ground electrode 27, the first fusion zone 351 is formed along the entire width of the noble metal tip 32.

Also, a plurality of the second fusion zones 352 are provided, and the second fusion zones 352 are formed in such a manner as to intersect with (in the present embodiment, to be substantially orthogonal to) the first fusion zone 351. The second fusion zones 352 are formed by radiating the laser beam or the like in such a manner as to intersect with (in the present embodiment, to be substantially orthogonal to) the first fusion zone 351, from the side from which the laser beam or the like has been radiated in forming the first fusion zone 351 (i.e., from the side toward the distal end surface 27F of the ground electrode 27). In the present embodiment, regarding at least the side of the fusion zone 35 which has been irradiated with the laser beam or the like (e.g., between a region irradiated with the laser beam or the like and a center axis CL2 of the noble metal tip 32), the thickness of the second fusion zones 352 along the center axis CL2 of the noble metal tip 32 is greater than the thickness of the first fusion zone 351 along the center axis CL2.

Also, in the present embodiment, the second fusion zones 352 are provided at the following positions. When the noble metal tip 32 and the fusion zone 35 are viewed from the side from which the laser beam or the like has been radiated to the surface (the distal end surface 27F) of the ground electrode 27, a portion of the fusion zone 35 located between the ground electrode 27 and the noble metal tip 32 is equally divided into three segmental regions along the width direction of the noble metal tip 32. At this time, in each of the three segmental regions, the second fusion zone 352 is provided in such a manner as to be in contact with the first fusion zone 351.

Additionally, the length of the outer surfaces of the second fusion zones 352 (L21+L22+L23+L24+L25) along the perimetrical direction (width direction) of the noble metal tip 32 is specified as 30% or more of a length L1 of the first fusion zone 351 along the perimetrical direction of the noble metal tip 32.

Figure 4:
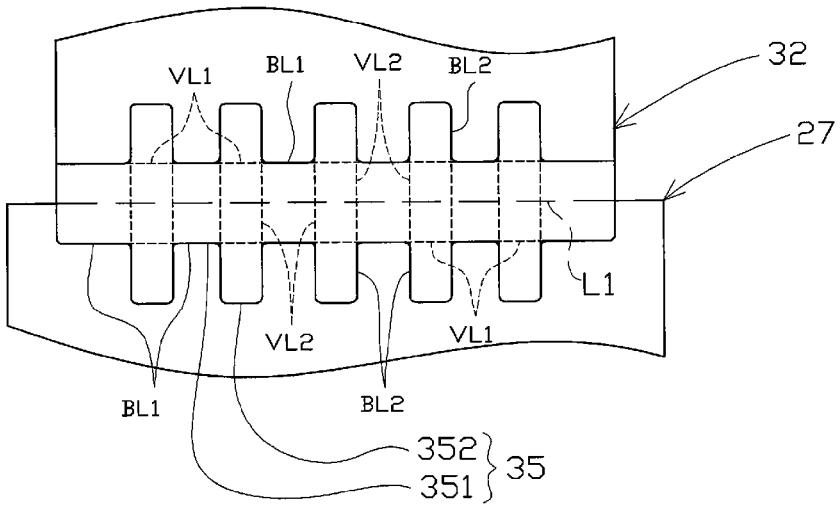
FIG. 4 Enlarged, schematic, side view for explaining the method of measuring the length of the outer surfaces of second fusion zones.

The length of the outer surfaces of the second fusion zones 352 along the perimetrical direction of the noble metal tip 32 can be measured as follows. As shown in FIG. 4, boundary lines BL1 between the first fusion zone 351 and the noble metal tip 32 are connected by imaginary straight lines VL1; boundary lines BL1 between the first fusion zone 351 and the ground electrode 27 are connected by the imaginary straight lines VL1; and a surface sandwiched between a group of the boundary lines BL1 and the imaginary straight lines VL1 on one side and a group of the boundary lines BL1 and the imaginary straight lines VL1 on the other side is specified as the outer surface of the first fusion zone 351. Meanwhile, a boundary line BL2 between the second fusion zone 352 and the noble metal tip 32 and the boundary line BL2 between the second fusion zone 352 and the ground electrode 27 are connected by imaginary straight lines VL2, and a surface surrounded by the boundary lines BL2 and the imaginary straight lines VL2 is specified as the outer surface of the second fusion zone 352. Next, a region where the specified outer surface of the first fusion zone 351 and the specified outer surface of the second fusion zone 352 overlap each other is specified as an overlap region. There is drawn a straight line L1 which passes through the center of the outer surface of the first fusion zone 352 with respect to the direction along the center axis CL2. The total length of those line segments of the straight line L1 which pass through the respective overlap regions is measured, whereby there can be obtained the length of the outer surfaces of the second fusion zones 352 along the perimetrical direction of the noble metal tip 32.

Figure 5:
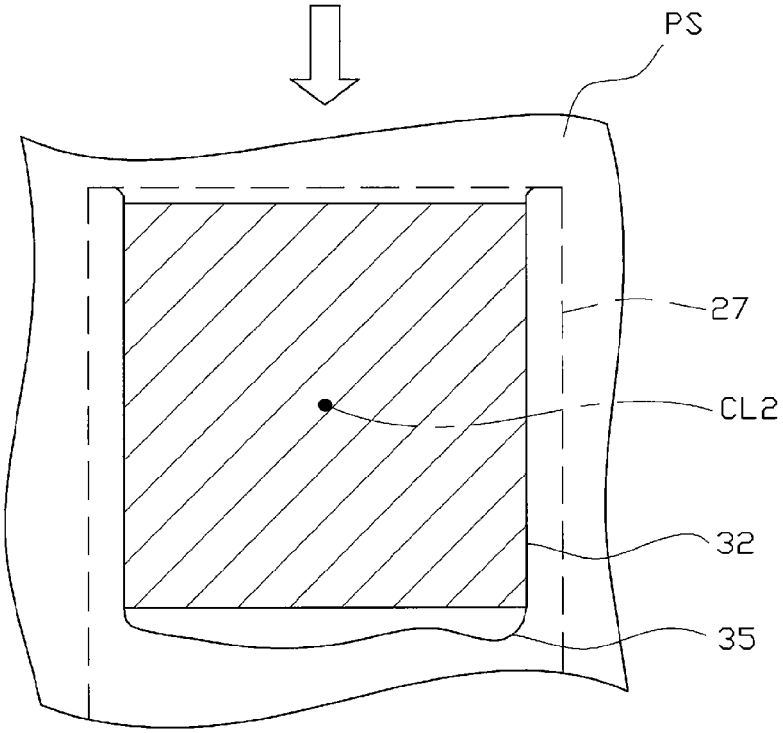
FIG. 5 Projection view showing a plane of projection on which a noble metal tip and the fusion zone are projected.

Furthermore, in the present embodiment, as shown in FIG. 5 (the arrow in FIG. 5 indicates the direction of radiation of the laser beam or the like), as viewed on a plane of projection PS which is orthogonal to the center axis CL2 and on which the noble metal tip 32 and the fusion zone 35 are projected along the center axis CL2 of the noble metal tip 32, a projected overlap region (the hatched region in FIG. 5) of the noble metal tip 32 and the fusion zone 35 accounts for 50% or more (in the present embodiment, 100%) of a projected region of the noble metal tip 32. That is, half or more of one end surface (in the present embodiment, the entire one end surface) of the noble metal tip 32 is joined to the ground electrode 27 via the fusion zone 35.

Meanwhile, the noble metal tip 32 is relatively thin as mentioned above, and, in view of sufficiently reducing the amount of fusion of the noble metal tip 32 in forming the fusion zone 35 so as to ensure a sufficient volume of the noble metal tip 32, the first fusion zone 351 is formed relatively thin. In the present embodiment, the maximum thickness $T_{MAX}$ of the first fusion zone 351 along the center axis CL2 of the noble metal tip 32 is specified as 0.3 mm or less (see FIG. 3).

Figure 6:
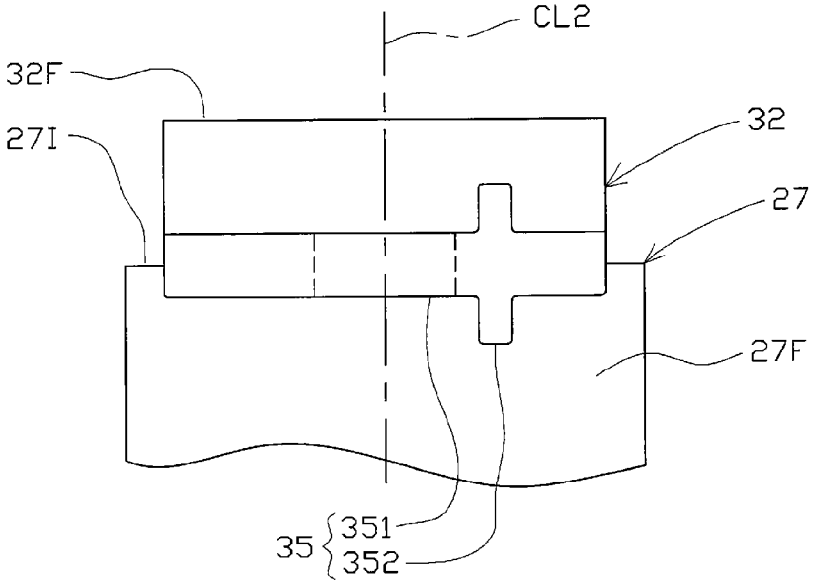
FIG. 6 Fragmentary, enlarged, side view showing another example of the fusion zone.
Figure 7:
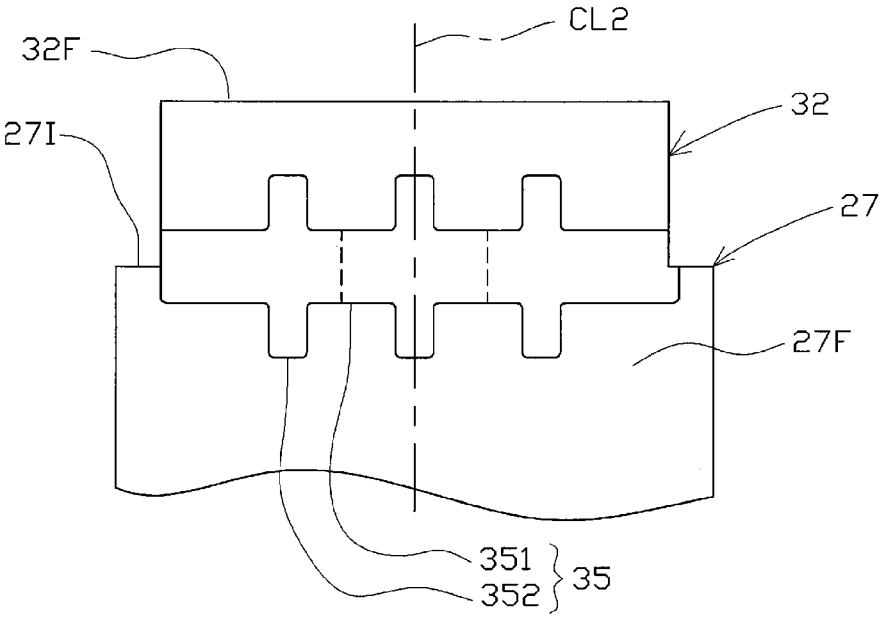
FIG. 7 Fragmentary, enlarged, side view showing a further example of the fusion zone.
Figure 8:
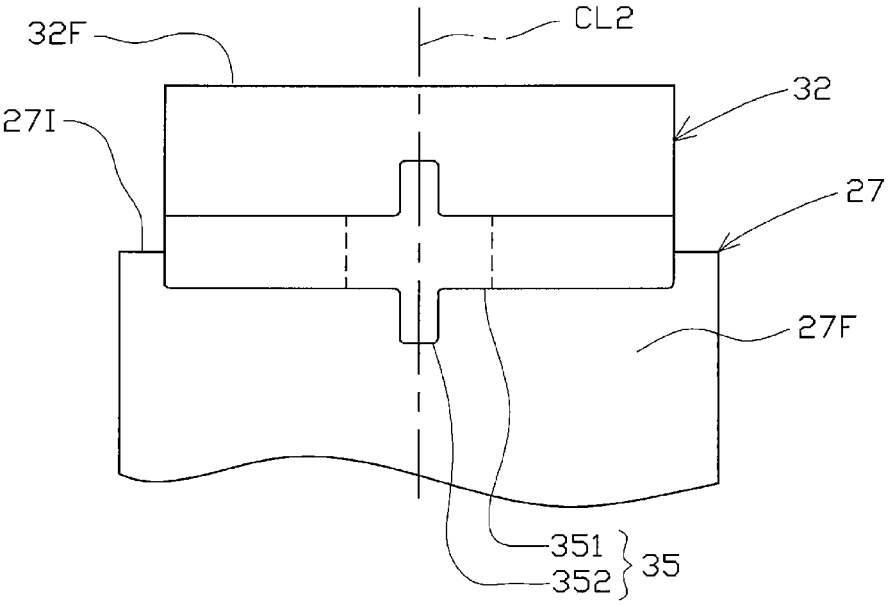
FIG. 8 Fragmentary, enlarged, side view showing a still further example of the fusion zone.
Figure 9:
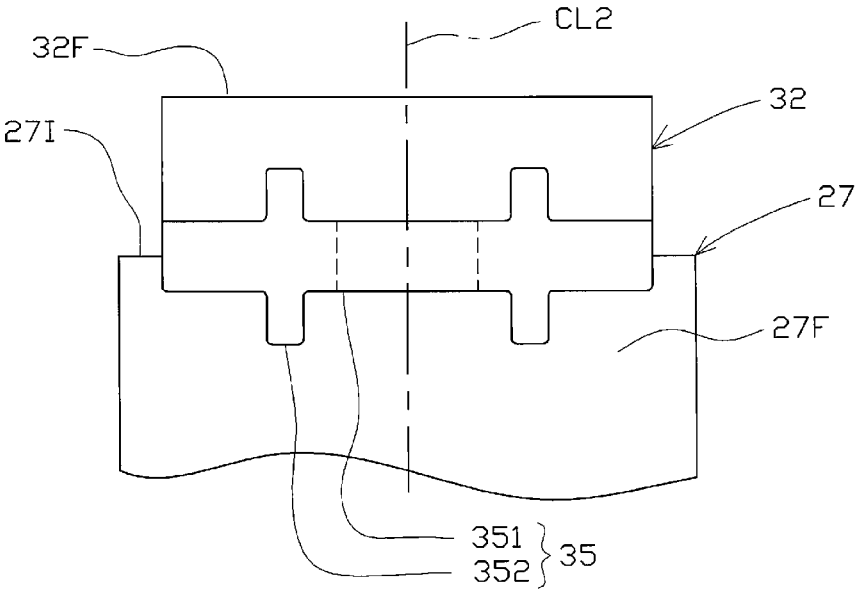
FIG. 9 Fragmentary, enlarged, side view showing yet another example of the fusion zone.

The number of the second fusion zones 352 is not particularly limited; for example, the number of the second fusion zones 352 may be changed as shown in FIGS. 6 and 7. Also, no particular limitation is imposed on the positions of the second fusion zones 352 in relation to the first fusion zone 351 (the noble metal tip 32). For example, as shown in FIG. 8, the first fusion zone 351 and the second fusion zone 352 may be in contact with each other only in the center one of the three segmental regions. Alternatively, as shown in FIG. 9, the first fusion zone 351 and the second fusion zone 352 may be in contact with each other only in opposite end ones of the three segmental regions.

Figure 10:
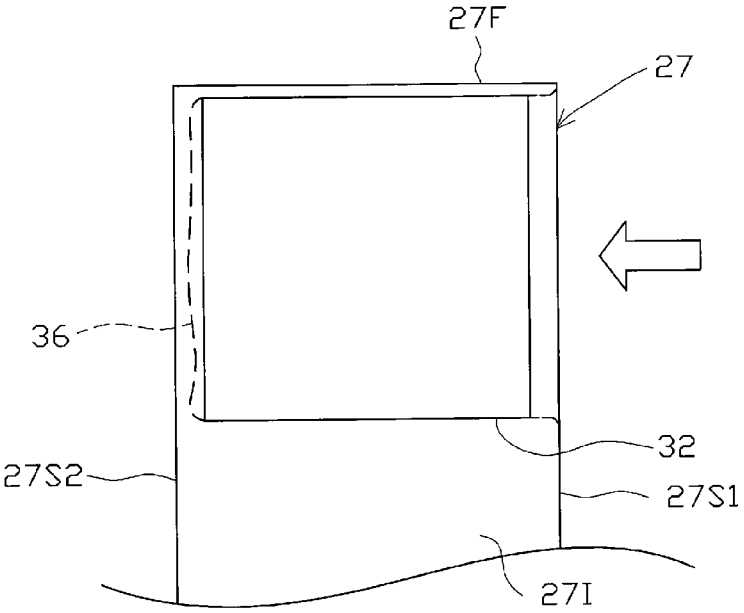
FIG. 10 Fragmentary, enlarged, plan view showing another example of the fusion zone.
Figure 11:
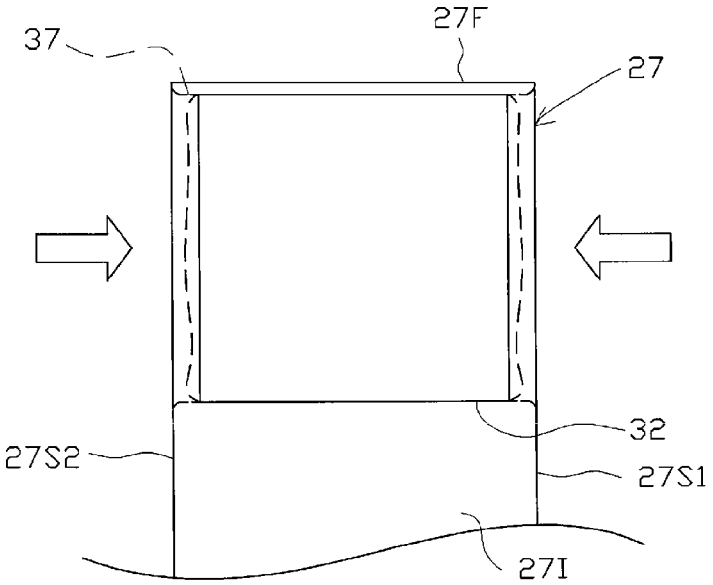
FIG. 11 Fragmentary, enlarged, plan view showing a further example of the fusion zone.
Figure 12:
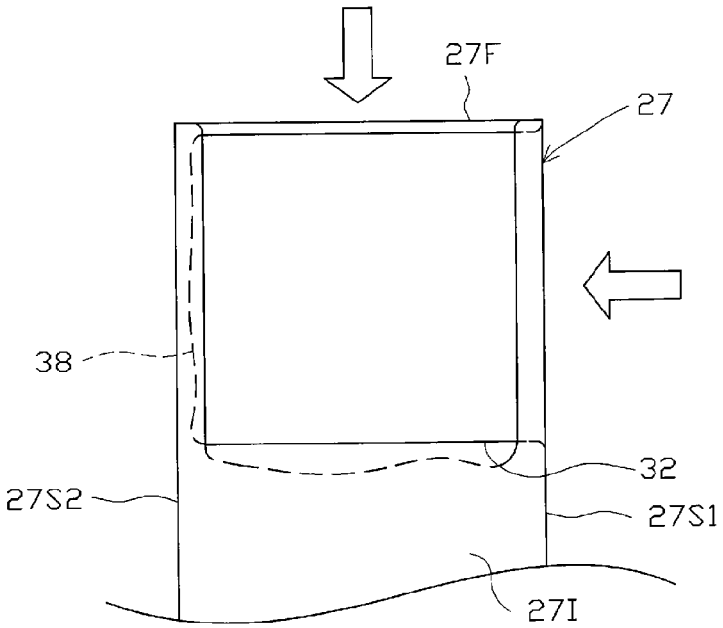
FIG. 12 Fragmentary, enlarged, plan view showing a still further example of the fusion zone.
Figure 13:
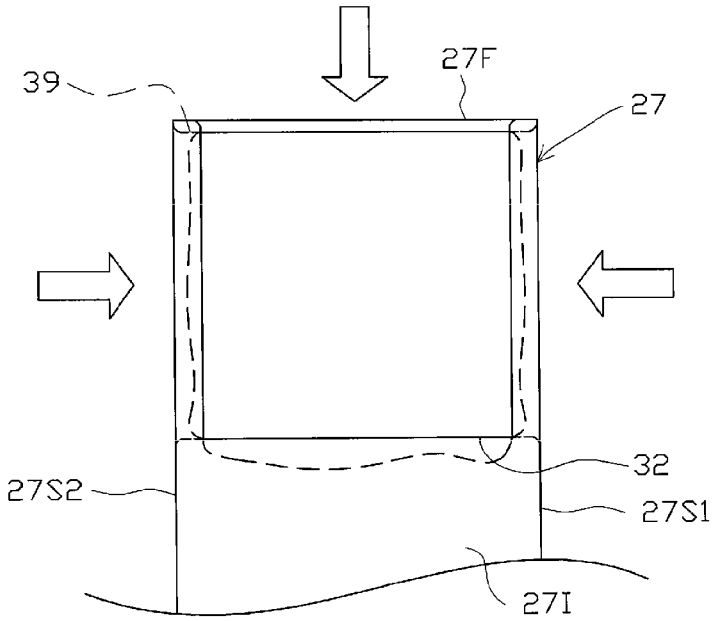
FIG. 13 Fragmentary, enlarged, plan view showing yet another example of the fusion zone.

Furthermore, a side from which the laser beam or the like is radiated is not limited to the side toward the distal end surface 27F of the ground electrode 27. As shown in FIG. 10 (the arrows in FIGS. 10 to 13 indicate the direction of radiation of the laser beam or the like), a fusion zone 36 may be formed through radiation of the laser beam or the like from a side toward one of side surfaces 27S1 and 27S2 adjacent to both of the distal end surface 27F and the inner side surface 27I of the ground electrode 27. Also, as shown in FIG. 11, a fusion zone 37 may be formed through radiation of the laser beam or the like from both sides toward the opposite side surfaces 27S1 and 27S2; alternatively, as shown in FIG. 12, a fusion zone 38 may be formed through radiation of the laser beam or the like from a side toward one of the opposite side surfaces 27S1 and 27S2 and from a side toward the distal end surface 27F. Furthermore, as shown in FIG. 13, a fusion zone 39 may be formed through radiation of the laser beam or the like from the side toward the distal end surface 27F and from the sides toward the opposite side surfaces 27S1 and 27S2.

Figure 14:
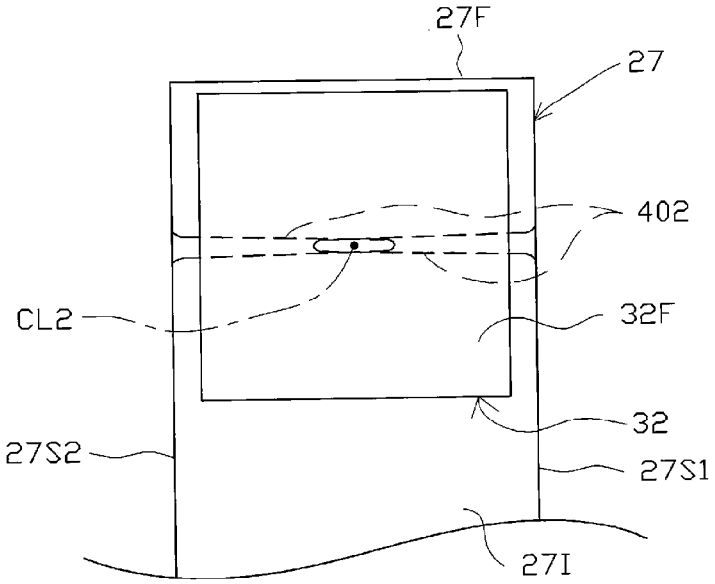
FIG. 14 Fragmentary, enlarged, plan view showing another example of a second fusion zone.

Additionally, as shown in FIG. 14 (in FIGS. 14 to 16, the first fusion zone is not shown), when the noble metal tip 32 and second fusion zones 402 are viewed from a side toward the other end surface 32F of the noble metal tip 32, the second fusion zones 402 may exist at positions located symmetrically with respect to the center axis CL2 of the noble metal tip 32.

Figure 15:
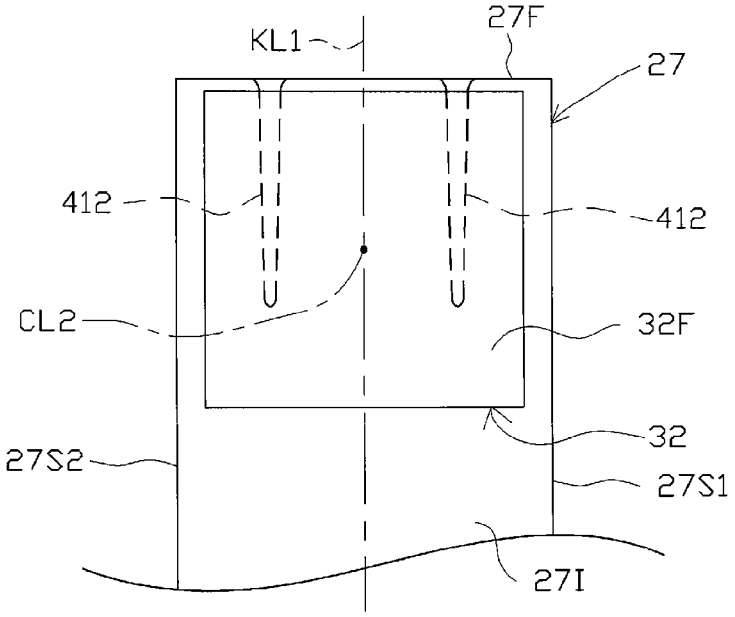
FIG. 15 Fragmentary, enlarged, plan view showing a further example of the second fusion zone.
Figure 16:
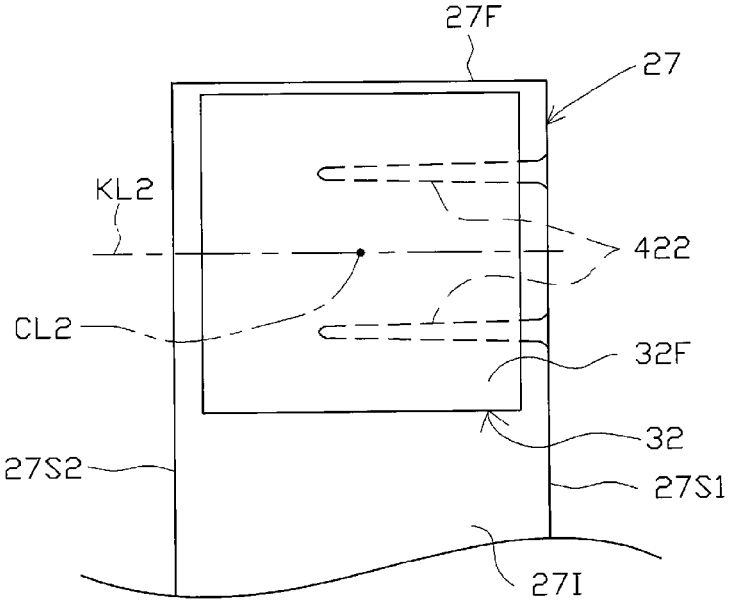
FIG. 16 Fragmentary, enlarged, plan view showing a still further example of the second fusion zone.

Furthermore, as shown in FIG. 15, as viewed from the side toward the other end surface 32F of the noble metal tip 32, second fusion zones 412 may be formed at positions located symmetrically with respect to a straight line (baseline) KL1 which extends along the longitudinal direction of the ground electrode 27 and passes through the center axis CL2 of the noble metal tip 32. Also, as shown in FIG. 16, as viewed from the side toward the other end surface 32F of the noble metal tip 32, second fusion zones 422 may be formed at positions located symmetrically with respect to a straight line (baseline) KL2 which extends along a direction orthogonal to the longitudinal direction of the ground electrode 27 and passes through the center axis CL2 of the noble metal tip 32.

Figure 17:
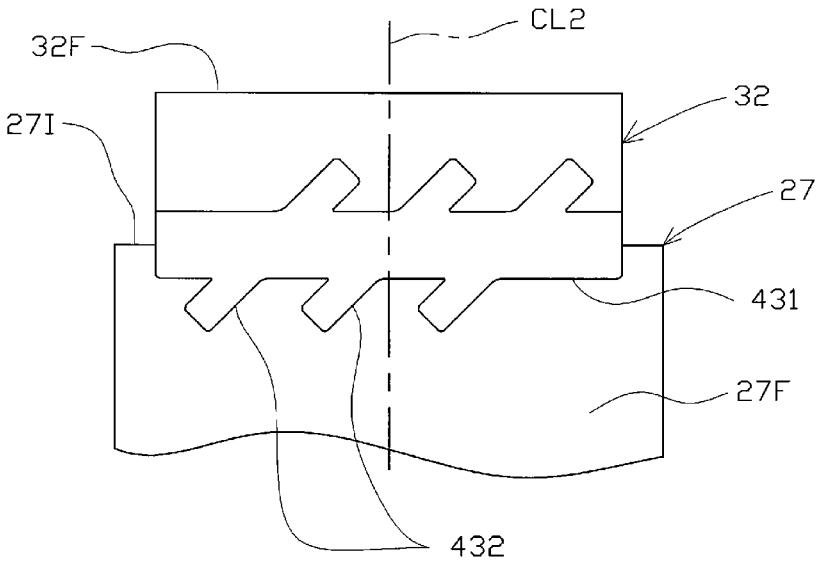
FIG. 17 Fragmentary, enlarged, side view showing yet another example of the second fusion zone.

Additionally, instead of forming the second fusion zones 352 orthogonally to the first fusion zone 351, for example, as shown in FIG. 17, second fusion zones 432 may be formed in such a manner as to obliquely intersecting with a first fusion zone 431.

Figure 18:
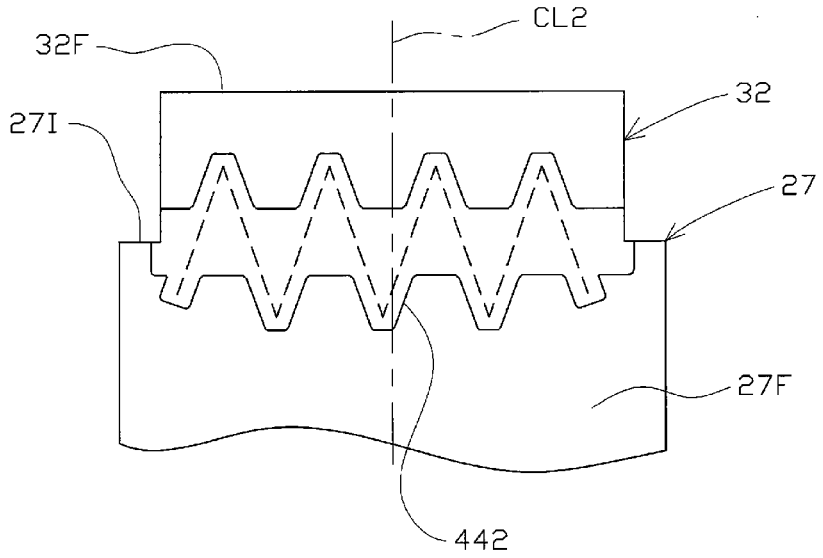
FIG. 18 Fragmentary, enlarged, side view showing another example of the second fusion zone.

Furthermore, the second fusion zone may be formed by continuously radiating the laser beam or the like; for example, as shown in FIG. 18 (the dotted line in FIG. 18 indicates a moving path of the position of radiation of the laser beam or the like in forming a second fusion zone 442), the second fusion zone 442 may be wavily formed by wavily radiating the laser beam or the like.

Next, a method of manufacturing the spark plug 1 configured as mentioned above is described. First, the metallic shell 3 is formed beforehand. Specifically, a circular columnar metal material is subjected to cold forging or the like for forming a general shape and a through hole. Subsequently, machining is conducted so as to adjust the outline, thereby yielding a metallic-shell intermediate.

Then, the ground electrode 27 having the form of a straight rod and formed from an Ni alloy is resistance-welded to the forward end surface of the metallic-shell intermediate. The resistance welding is accompanied by formation of so-called "welding droop." After the "welding droop" are removed, the threaded portion 15 is formed in a predetermined region of the metallic-shell intermediate by rolling. Thus, the metallic shell 3 to which the ground electrode 27 is welded is obtained. The metallic shell 3 to which the ground electrode 27 is welded is subjected to galvanization or nickel plating. In order to enhance corrosion resistance, the plated surface may be further subjected to chromate treatment.

Separately from preparation of the metallic shell 3, the ceramic insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping. The shaped green compact is placed in a kiln, followed by firing for forming the ceramic insulator 2.

Also, separately from preparation of the metallic shell 3 and the ceramic insulator 2, the center electrode 5 is formed. Specifically, an Ni alloy prepared such that a copper alloy or the like is disposed in a central portion thereof for the purpose of enhancing heat radiation is subjected to forging, thereby forming the center electrode 5. Next, the noble metal member 31 made of a noble metal alloy is joined to a forward end portion of the center electrode 5 by laser welding or the like.

Next, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched therebetween. Subsequently, the resultant assembly is heated in a kiln while the charged mixture is pressed from the rear by the terminal electrode 6, thereby being fired and fixed. At this time, a glaze layer may be simultaneously fired on the surface of the rear trunk portion 10 of the ceramic insulator 2; alternatively, the glaze layer may be formed beforehand.

Subsequently, the ceramic insulator 2 having the center electrode 5 and the terminal electrode 6, and the metallic shell 3 having the ground electrode 27, which are respectively formed as mentioned above, are fixed together. More specifically, in a state in which the ceramic insulator 2 is inserted into the metallic shell 3, a relatively thin-walled rear-end opening portion of the metallic shell 3 is crimped radially inward; i.e., the above-mentioned crimp portion 20 is formed, thereby fixing the ceramic insulator 2 and the metallic shell 3 together.

Next, the noble metal tip 32 is joined to a distal end portion of the ground electrode 27. Specifically, in a state in which the noble metal tip 32 is supported by a predetermined pressing pin, a high-energy laser beam such as a fiber laser beam or an electron beam, is radiated to a boundary region between the ground electrode 27 and the noble metal tip 32 from a side toward the distal end surface 27F of the ground electrode 27, while the position of radiation of laser is moved along the perimetrical direction (width direction) of the noble metal tip 32. By this procedure, the first fusion zone 351 is formed. In forming the first fusion zone 351, the direction of radiation of the high-energy laser beam is set parallel to the other end surface 32F of the noble metal tip 32. Also, conditions of radiation of the laser beam or the like are set such that, while the first fusion zone 351 is being formed in the entire region between the noble metal tip 32 and the ground electrode 27, the formed first fusion zone 351 has a maximum thickness $T_{MAX}$ of 0.3 mm or less. Specifically, since the thickness of the first fusion zone 351 relatively increases by reducing the working speed, and the thickness of the first fusion zone 351 relatively reduces by increasing the working speed, while output energy is set relatively large, the working speed is set relatively high. Also, the spot diameter of the fiber laser beam is set to a sufficiently small value of five hundredths mm or less. By virtue of this, the first fusion zone 351 is formed sufficiently wide and relatively thin.

Next, the high-energy beam is radiated from the side (the side toward the distal end surface 27F of the ground electrode 27) from which the high-energy laser beam has been radiated in forming the first fusion zone 351, while the position of radiation of laser is moved along the direction of the center axis CL2 so as to intersect with the formed first fusion zone 351. This radiation of the laser beam is performed intermittently along the perimetrical direction (width direction) of the noble metal tip 32, whereby a plurality of the second fusion zones 352 are formed. As a result, the fusion zone 35 composed of the first fusion zone 351 and the second fusion zones 352 is formed, whereby the noble metal tip 32 is joined to the ground electrode 27. In forming the second fusion zones 352, in order to enhance working accuracy, a galvano scanner may be used.

In forming the fusion zone 35, conditions of radiation of the high-energy laser beam (e.g., output and radiation time of the laser beam or the like) may be modified according to the diameter of the noble metal tip 32, material used to form the noble metal tip 32, etc.

After the noble metal tip 32 is joined, a substantially middle portion of the ground electrode 27 is bent toward the center electrode 5, and the magnitude of the spark discharge gap 33 between the noble metal member 31 and the noble metal tip 32 is adjusted, thereby yielding the spark plug 1 described above.

As described above in detail, according to the present embodiment, by virtue of the presence of the second fusion zones 352, at least portions of the fusion zone 35 are thicker than the first fusion zone 351. Therefore, the thick portions, which are superior to the first fusion zone 351 in the capability of absorbing a stress difference, can effectively absorb an excess stress difference between the noble metal tip 32 and the ground electrode 27 associated with thermal expansion which the first fusion zone 351 has failed to absorb.

Furthermore, the provision of the second fusion zones 352 renders the boundary surface between the fusion zone 35 and the noble metal tip 32 and the boundary surface between the fusion zone 35 and the ground electrode 27 at least partially protrusive. Therefore, the protrusions function as, so to speak, wedges, whereby movement of the fusion zone 35 in relation to the ground electrode 27 or the like along the boundary surface can be more reliably restrained.

Also, according to the present embodiment, as compared with the case where the first fusion zone 351 is merely rendered thick, the volume of the fusion zone 35 can be sufficiently small. Thus, a portion of the noble metal tip 32 which fuses in the joining process can be reduced, whereby there can be more reliably prevented the exposure of the fusion zone 35 to the spark discharge gap 33 and a situation in which the noble metal tip 32 becomes excessively thin.

As mentioned above, according to the present embodiment, while the effect of improving erosion resistance through provision of the noble metal tip 32 is sufficiently exhibited, the effect of effectively absorbing a stress difference and the effect of preventing movement of the fusion zone 35 through provision of the second fusion zone 352 can synergize, whereby the separation of the noble metal tip 32 can be quite effectively prevented.

Also, as viewed from the side from which the laser beam or the like is radiated, the first fusion zone 351 is formed along the entire width of the noble metal tip 32, and, assuming that the fusion zone 35 is divided into three segmental regions along its perimetrical direction (width direction), the first fusion zone 351 and the second fusion zone 352 are in contact with each other in each of the three segmental regions. Therefore, the effect of absorbing a stress difference by the first fusion zone 351 is enhanced, and the stress difference is evenly applied to the thick portions (the second fusion zones 352) of the fusion zone 35. As a result, the fusion zone 35 can more effectively absorb a stress difference, and the separation of the noble metal tip 32 can be quite effectively prevented.

Furthermore, according to the present embodiment, the length of the outer surfaces of the second fusion zones 352 along the perimetrical direction of the noble metal tip 32 is 30% or more of the length of the outer surface of the first fusion zone 351 along the perimetrical direction of the noble metal tip 32. That is, the second fusion zones 352 are formed over a relatively wide range of a boundary region between a perimetrical portion of the noble metal tip 32 and the ground electrode 27, the boundary region being where a particularly large stress difference arises in association with thermal expansion. Therefore, a stress difference associated with thermal expansion can be more reliably absorbed, whereby separation resistance can be further improved.

Particularly, in the case where, as in the case of the present embodiment, the first fusion zone 351 is thin such that the maximum thickness $T_{MAX}$ is 0.3 mm or less, and thus encounters difficulty in absorbing a stress difference by the first fusion zone 351, with resultant involvement of further concern over the separation of the noble metal tip 32, the provision of the second fusion zones 352 is effective.

Second Embodiment

Figure 19:
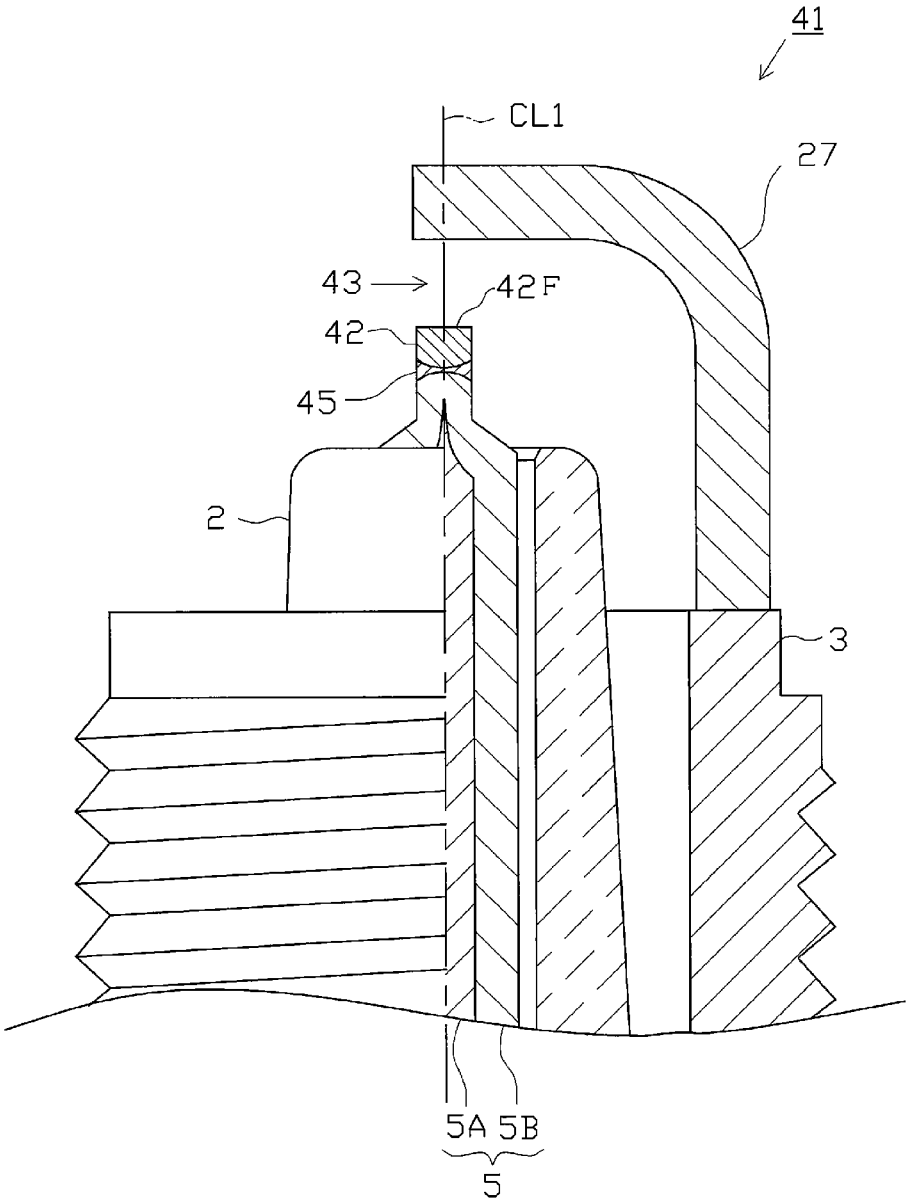
FIG. 19 Partially cutaway, enlarged, front view showing the configuration of a forward end portion of a spark plug according to a second embodiment.

Next, the second embodiment will be described, centering on points of difference from the first embodiment described above. As shown in FIG. 19, a spark plug 41 according to the second embodiment is such that a noble metal tip 42 is joined to a forward end portion of the center electrode 5 via a fusion zone 45 formed through radiation of a laser beam or an electron beam (i.e., in the second embodiment, the center electrode 5 is an "object member"). Meanwhile, the ground electrode 27 does not have a noble metal tip; thus, a spark discharge gap 43 is formed between the noble metal tip 42 and the ground electrode 27.

Figure 20:
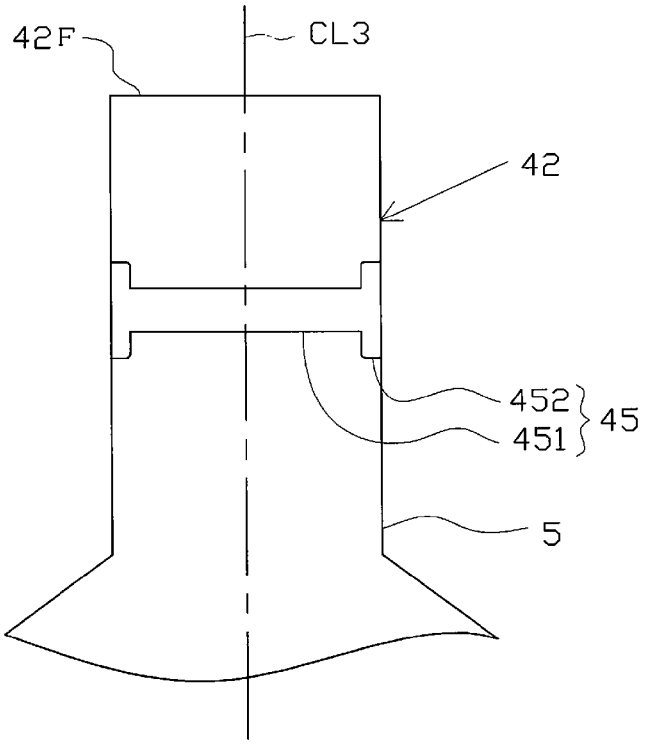
FIG. 20 Fragmentary, enlarged, front view showing the configuration of a fusion zone, etc., in the second embodiment.

The fusion zone 45 is formed so as to satisfy the following configuration. The fusion zone 45 is formed in the entire region between the noble metal tip 42 and the center electrode 5, so that the entire one end surface of the noble metal tip 42 is joined to the center electrode 5. Also, as shown in FIG. 20, the fusion zone 45 includes a first fusion zone 451 and second fusion zones 452.

The first fusion zone 451 is formed by continuously radiating the laser beam or the electron beam to the boundary region between the center electrode 5 and the one end surface of the noble metal tip 42, along the circumferential direction of the noble metal tip 42. Also, the first fusion zone 451 is formed along the entire circumference of the noble metal tip 42 and assumes the form of a disk extending substantially along the other end surface 42F of the noble metal tip 42.

Figure 21:
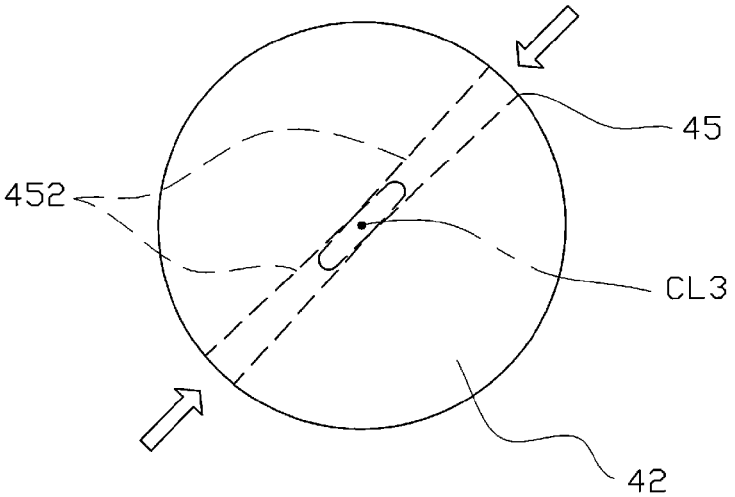
FIG. 21 Fragmentary, enlarged, plan view showing the configuration of a second fusion zone.

Additionally, the second fusion zones 452 are formed by radiating the laser beam or the like in such a manner as to intersect with (in the present embodiment, to be orthogonal to) the first fusion zone 451, from the side from which the laser beam or the like has been radiated in forming the first fusion zone 451. In the present embodiment, a plurality of the second fusion zones 452 are provided, and as shown in FIG. 21 (the arrows in FIGS. 21 to 28 indicate the direction of radiation of the laser beam or the like), as viewed from the side toward the other end surface 42F of the noble metal tip 42, the second fusion zones 452 are formed at positions located symmetrically with respect to a center axis CL3 of the noble metal tip 42 (in the present embodiment, at symmetrical positions with respect to the center axis CL3).

Figure 22:
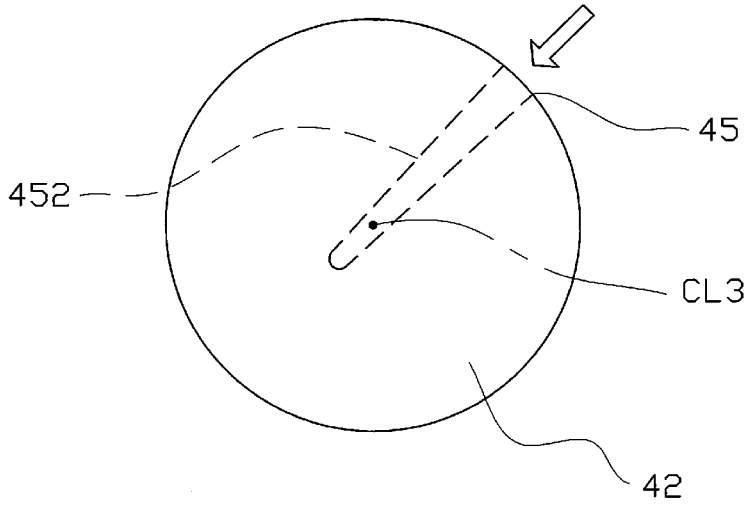
FIG. 22 Fragmentary, enlarged, plan view showing another example of the second fusion zone.
Figure 23:
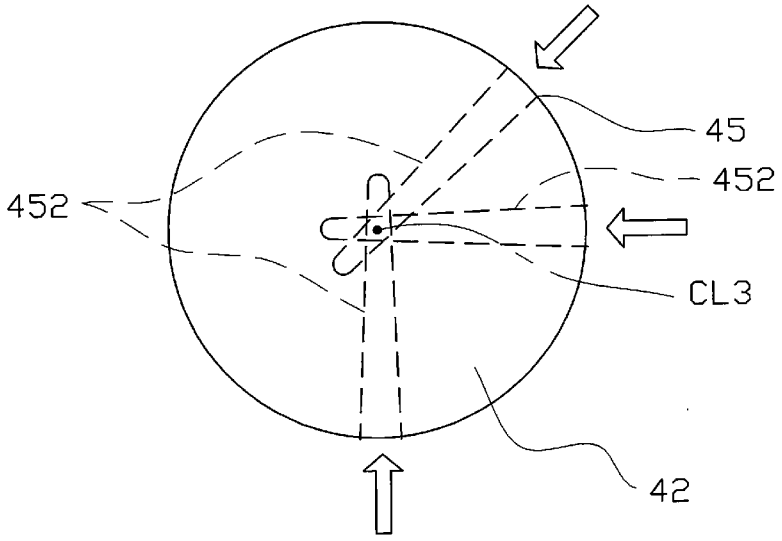
FIG. 23 Fragmentary, enlarged, plan view showing a further example of the second fusion zone.
Figure 24:
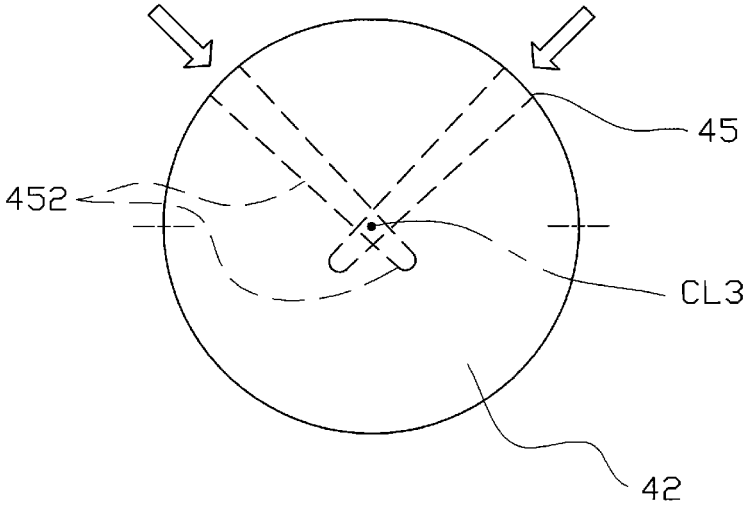
FIG. 24 Fragmentary, enlarged, plan view showing a still further example of the second fusion zone.
Figure 25:
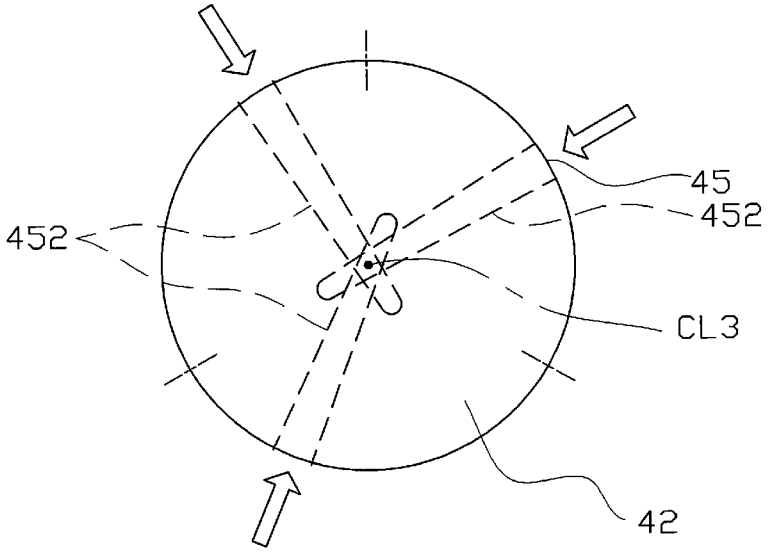
FIG. 25 Fragmentary, enlarged, plan view showing yet another example of the second fusion zone.
Figure 26:
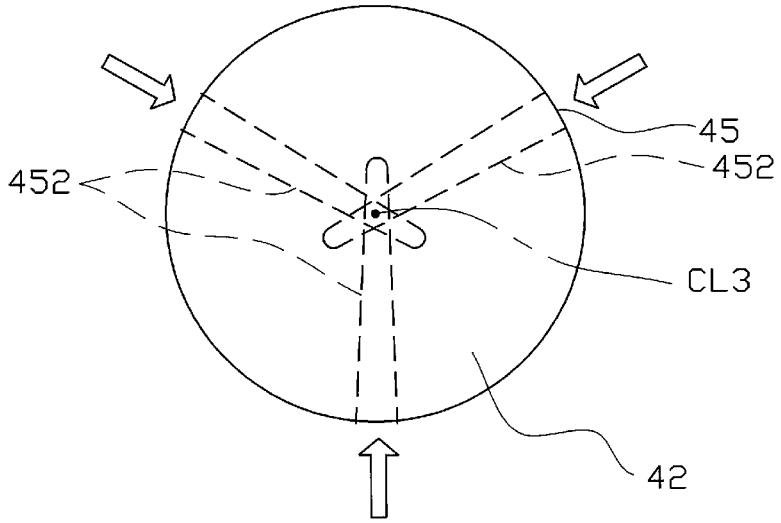
FIG. 26 Fragmentary, enlarged, plan view showing another example of the second fusion zone.
Figure 27:
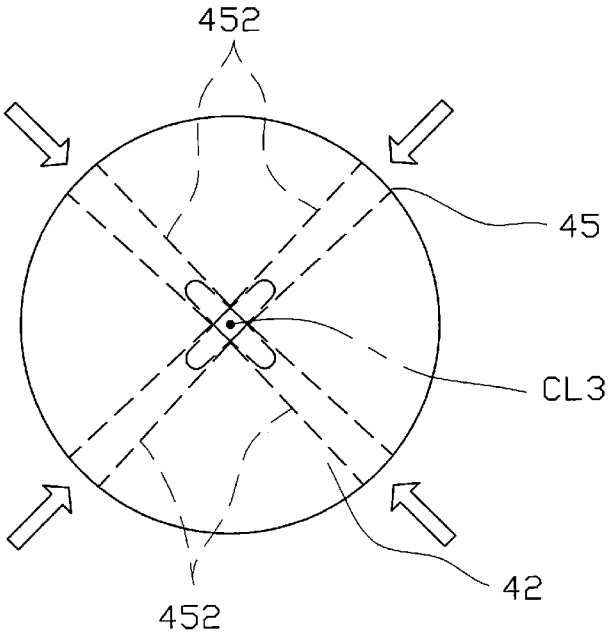
FIG. 27 Fragmentary, enlarged, plan view showing a further example of the second fusion zone.
Figure 28:
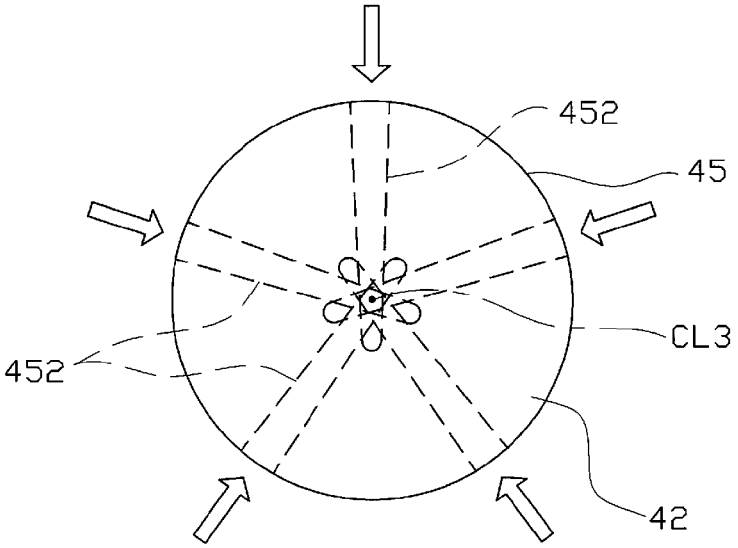
FIG. 28 Fragmentary, enlarged, plan view showing a still further example of the second fusion zone.

No particular limitation is imposed on the number of the second fusion zones 452. For example, as shown in FIG. 22, only a single second fusion zone 452 may be provided; alternatively, as shown in FIG. 23, three or more second fusion zones 452 may be provided. Also, no particular limitation is imposed on the positions where the second fusion zones 452 are provided. For example, as shown in FIG. 24, when the outer circumferential surface of the fusion zone 45 is equally divided along its circumferential direction into two segmental regions, the second fusion zones 452 may be present in only one of the two segmental regions. Also, as shown in FIG. 25, when the outer circumferential surface of the fusion zone 45 is equally divided along its circumferential direction into three segmental regions, the second fusion zone 452 may be present in each of the three segmental regions. Furthermore, as shown in FIGS. 26 to 28, when the second fusion zones 452 and the noble metal tip 42 are viewed from the side toward the other end surface 42F of the noble metal tip 42, the second fusion zones 452 may be formed at symmetrical positions with respect to the center axis CL3 of the noble metal tip 42. Notably, the second fusion zones 452 are not necessarily formed at strictly symmetrical positions with respect to the center axis CL3 of the noble metal tip 42, but may be formed at positions slightly deviated from the symmetrical positions.

Figure 29:
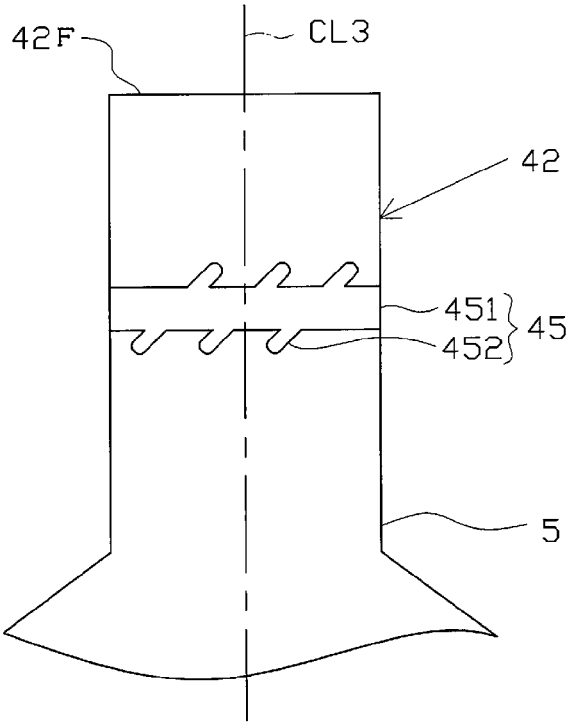
FIG. 29 Fragmentary, enlarged, front view showing yet another example of the second fusion zone.

Also, as shown in FIG. 29, the second fusion zones 452 may be formed in such a manner as to obliquely intersect with the first fusion zone 451.

Figure 30:
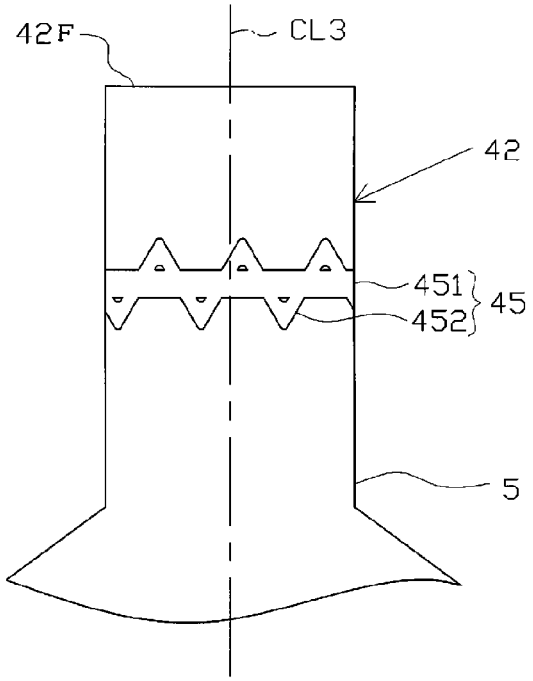
FIG. 30 Fragmentary, enlarged, front view showing another example of the second fusion zone.

Furthermore, as shown in FIG. 30, the second fusion zone 452 may be formed in such a manner that its outer surface waves, by continuously (wavily) radiating the laser beam or the like.

The second embodiment yields actions and effects similar to those yielded by the above-described first embodiment with respect to the relation between the center electrode 5 and the noble metal tip 42 to be joined to the center electrode 5. That is, separation resistance can be greatly improved for the noble metal tip 42 joined to the center electrode 5.

Third Embodiment

Figure 31:
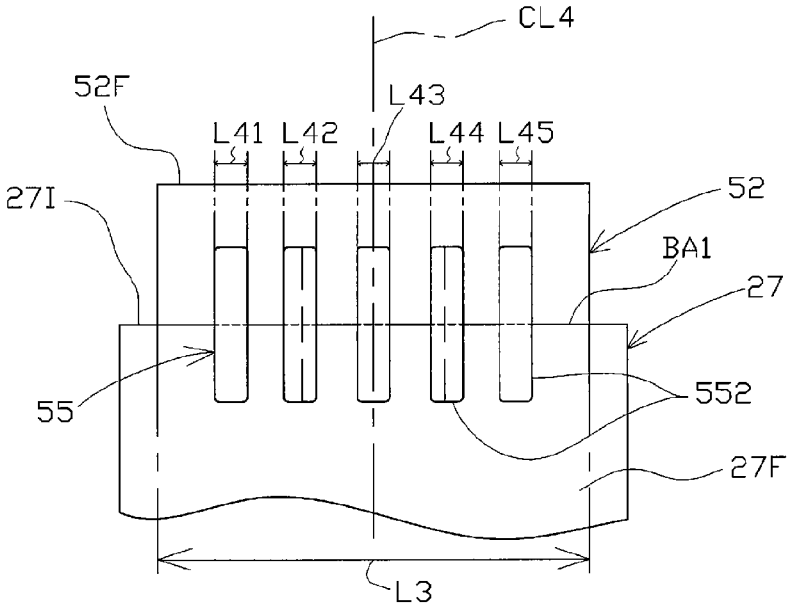
FIG. 31 Fragmentary, enlarged, side view showing the configuration of a fusion zone in a third embodiment.

Next, the third embodiment will be described, centering on points of difference from the first embodiment described above. In the first embodiment described above, the fusion zone 35 includes the first fusion zone 351 and the second fusion zones 352, which intersect with the first fusion zone 351. However, in the third embodiment, as shown in FIG. 31, a fusion zone 55 is formed in the form of a plurality of segmental fusion zones 552 which extend along a center axis CL4 of a noble metal tip 52 in such a manner as to cross the boundary between the ground electrode 27 and one end surface of the noble metal tip 52. That is, the fusion zone 55 is composed of only the equivalents of the second fusion zones 352 in the first embodiment described above. The fusion zone 55 is formed by intermittently radiating a laser beam or an electron beam a plurality of times from the side toward the distal end surface 27F of the ground electrode 27 in such a manner as to intersect with a boundary BA1 between the noble metal tip 52 and the ground electrode 27.

Also, in the third embodiment, as viewed from the side (in the present embodiment, the side toward the distal end surface 27F of the ground electrode 27) from which the laser beam or the electron beam has been radiated, a portion of the outer surface of the fusion zone 55 located on the boundary BA1 between the noble metal tip 52 and the ground electrode 27 has a length (L41+L42+L43+L44+L45) which is 30% or more (more preferably 50% or more, far more preferably 70% or more) of the length L3 of the boundary BA1.

In actuality, a portion of the boundary BA1 between the noble metal tip 52 and the ground electrode 27 does not externally appear in association with formation of the fusion zone 55; however, the above expression "the boundary BA1 between the noble metal tip 52 and the ground electrode 27" means the boundary between the noble metal tip 52 and the ground electrode 27 on the assumption that the fusion zone 55 does not exist. Therefore, "the externally appearing boundary BA1 between the noble metal tip 52 and the ground electrode 27" means the boundary between the noble metal tip 52 and the ground electrode 27 which externally appears on the assumption that the fusion zone 55 does not exist. In the third embodiment, the boundary BA1 is a single line consisting of boundary segments which actually, externally appear, and imaginary line segments (the dotted line segments in FIG. 31) each of which connects the adjacent boundary segments.

Figure 32:
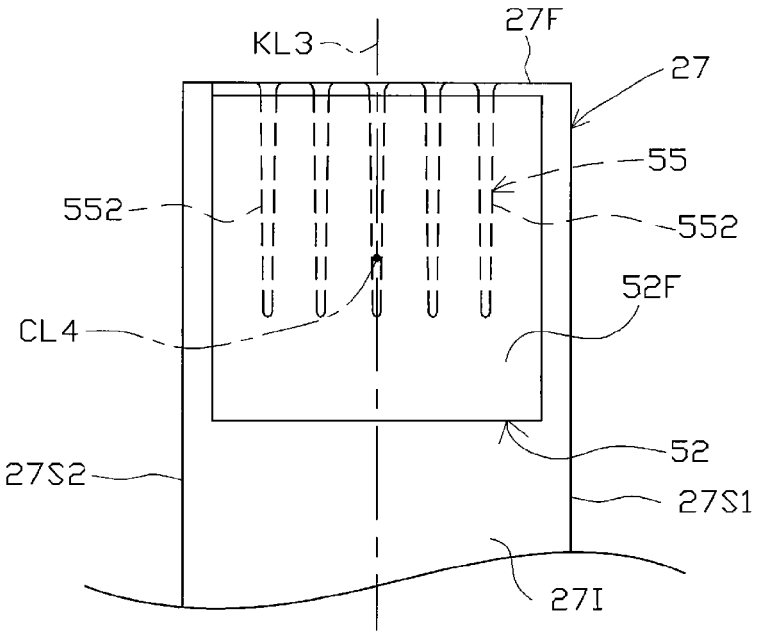
FIG. 32 Fragmentary, enlarged, plan view showing the configuration of the fusion zone in the third embodiment.

Additionally, in the third embodiment, as shown in FIG. 32, as viewed from the side toward the other end surface 52F of the noble metal tip 52, the segmental fusion zones 552 are formed at positions located symmetrically with respect to a straight line KL3 which extends along the longitudinal direction of the ground electrode 27 and passes through the center axis CL4 of the noble metal tip 52.

Figure 33:
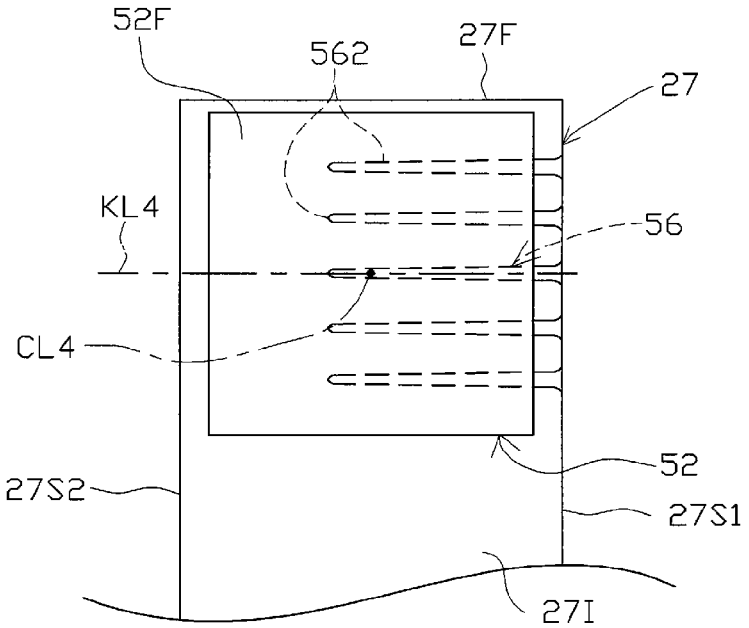
FIG. 33 Fragmentary, enlarged, plan view showing another example of the fusion zone.
Figure 34:
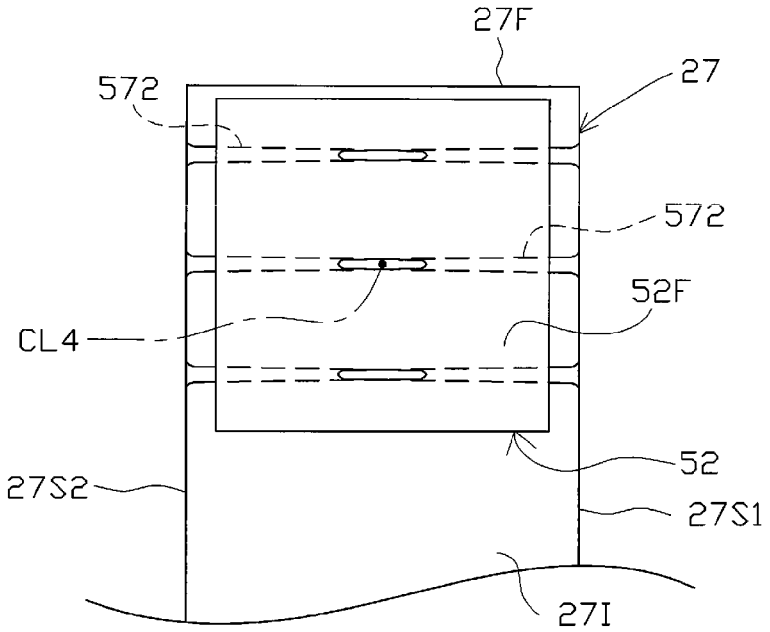
FIG. 34 Fragmentary, enlarged, plan view showing a further example of the fusion zone.

Notably, as shown in FIG. 33, a fusion zone 56 composed of a plurality of segmental fusion zones 562 may be formed by radiating the laser beam or the like from a side toward one of side surfaces 27S1 and 27S2 of the ground electrode 27 in such a manner as to intersect with the boundary BA1 between the noble metal tip 52 and the center electrode 5, without radiating the laser beam or the like from the side toward the distal end surface 27F of the ground electrode 27. Also, in this case, as viewed from the side toward the other end surface 52F of the noble metal tip 52, the segmental fusion zones 562 may be formed at positions located symmetrically with respect to a straight line KL4 which extends along a direction orthogonal to the longitudinal direction of the ground electrode 27 and passes through the center axis CL4 of the noble metal tip 52. Furthermore, as shown in FIG. 34, as viewed from the side toward the other end surface 52F of the noble metal tip 52, segmental fusion zones 572 may be formed at positions located symmetrically with respect to the center axis CL4 of the noble metal tip 52 by radiating the laser beam or the like from the sides toward the opposite side surfaces 27S1 and 27S2 of the ground electrode 27.

Figure 35:
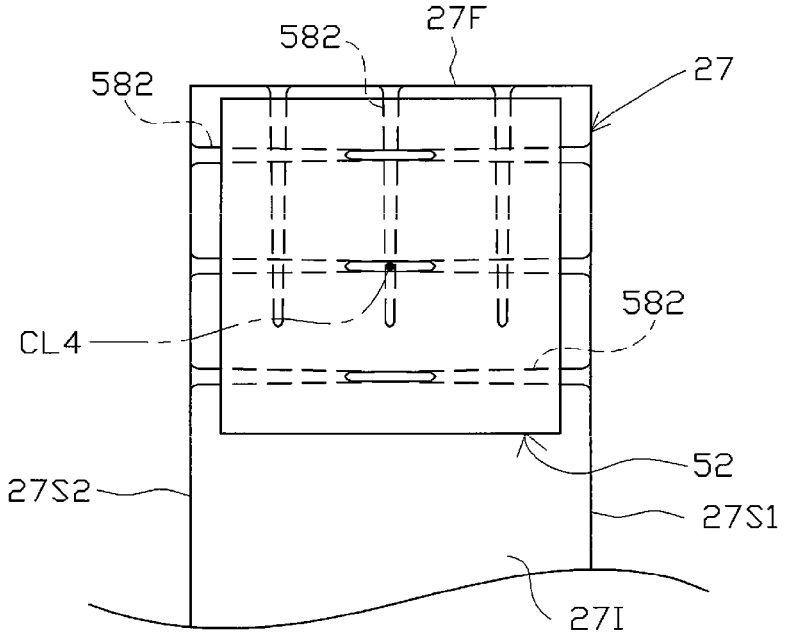
FIG. 35 Fragmentary, enlarged, plan view showing a still further example of the fusion zone.

Also, as shown in FIG. 35, through radiation of the laser beam or the like from the side toward each of the distal end surface 27F and the opposite side surfaces 27S1 and 27S2 of the ground electrode 27, the segmental fusion zones 582 are formed on the distal end surface 27F and the opposite side surfaces 27S1 and 27S2 of the ground electrode 27.

Figure 36:
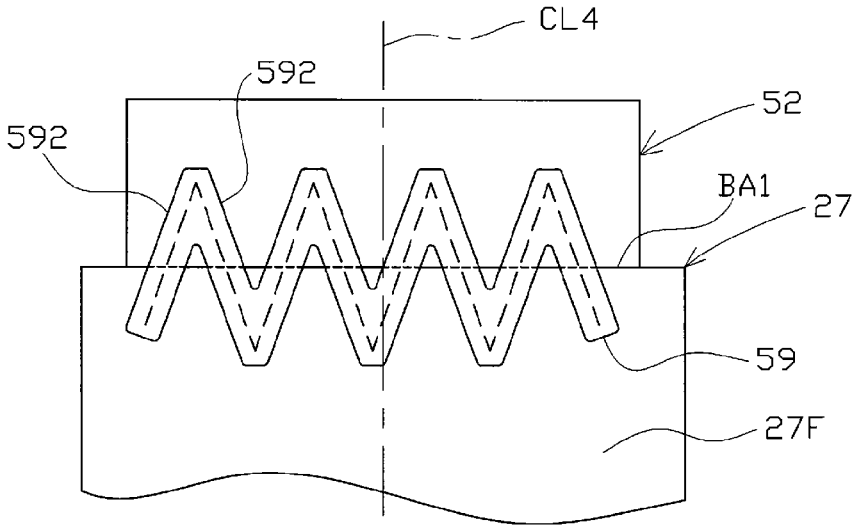
FIG. 36 Fragmentary, enlarged, side view showing yet another example of the fusion zone.

Additionally, as shown in FIG. 36, a fusion zone 59 may be formed of a plurality of segmental fusion zones 592 which are formed continuously, such that an externally exposed portion of the fusion zone 59 waves by wavily radiating the laser beam or the like to the boundary BA1 between the noble metal tip 52 and the ground electrode 27 instead of intermittently radiating the laser beam or the like.

According to the third embodiment, a plurality of the segmental fusion zones 552 penetrate into both of the ground electrode 27 and the noble metal tip 52. Therefore, the segmental fusion zones 552 function as, so to speak, wedges, whereby there can be restrained movement of the noble metal tip 52 in relation to the ground electrode 27 associated with a stress difference which arises between the noble metal tip 52 and the ground electrode 27. As a result, strength of joining the noble metal tip 52 can be improved, whereby excellent separation resistance can be implemented.

Furthermore, as viewed from the side toward the other end surface 52F of the noble metal tip 52, the segmental fusion zones 552 are formed at symmetrical positions with respect to the straight line KL3. That is, the segmental fusion zones 552 are disposed in a well balanced manner on the boundary surface between the noble metal tip 52 and the ground electrode 27. Therefore, the segmental fusion zones 552 more effectively exhibit the wedge function, whereby separation resistance can be further enhanced.

Also, as viewed from the side from which the laser beam or the like has been radiated, a portion of the outer surface of the fusion zone 55 located on the boundary BA1 between the noble metal tip 52 and the ground electrode 27 has a length (L41+L42+L43+L44+L45) which is 30% or more of a length L3 of the boundary BA1. That is, the segmental fusion zones 552 are formed over a relatively wide range of a boundary region between a perimetrical portion of the noble metal tip 52 and the ground electrode 27, the boundary region being where a particularly large stress difference arises. Therefore, the segmental fusion zones 552 can more effectively exhibit the wedge function, whereby separation resistance can be more improved.

Fourth Embodiment

Figure 37:
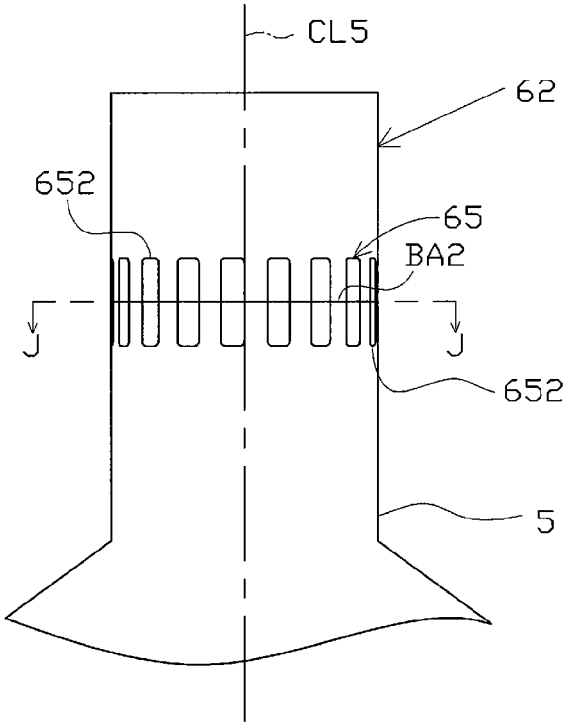
FIG. 37 Fragmentary, enlarged, front view showing the configuration of a fusion zone in a fourth embodiment.

Next, the fourth embodiment will be described, centering on points of difference from the third embodiment described above. In the third embodiment described above, the noble metal tip 52 is joined to the ground electrode 27 via the fusion zone 55; however, in the fourth embodiment, as shown in FIG. 37, a noble metal tip 62 is joined to a forward end portion of the center electrode 5 via a fusion zone 65. That is, in the third embodiment, the object member is the ground electrode 27, whereas, in the fourth embodiment, the object member is the center electrode 5.

The fusion zone 65 is formed in the form of a plurality of segmental fusion zones 652 which extend along a center axis CL5 of the noble metal tip 62 in such a manner as to cross a boundary BA2 between the center electrode 5 and one end surface of the noble metal tip 62. The fusion zone 65 is formed by intermittently radiating a laser beam or an electron beam a plurality of times from a side toward the outer circumference of the center electrode 5 in such a manner as to intersect with the boundary BA2 between the noble metal tip 62 and the center electrode 5.

Figure 38:
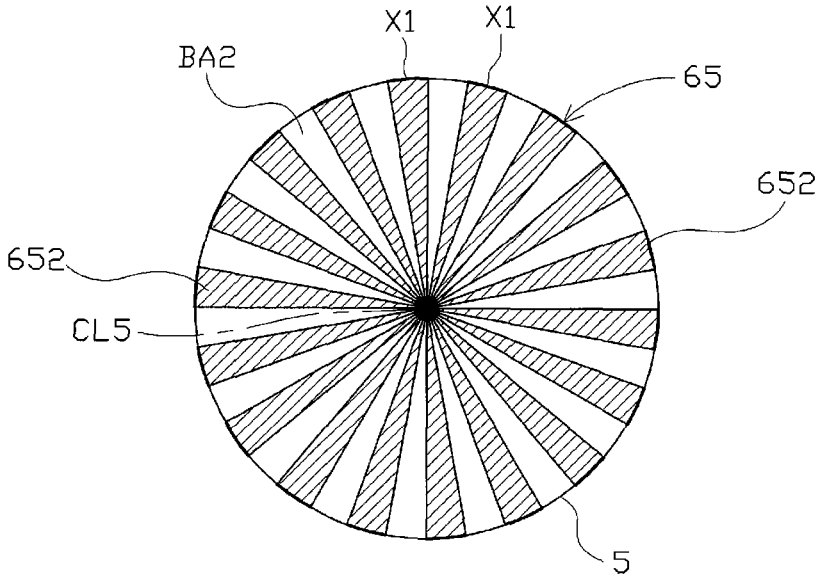
FIG. 38 Sectional view taken along line J-J of FIG. 37.
Figure 39:
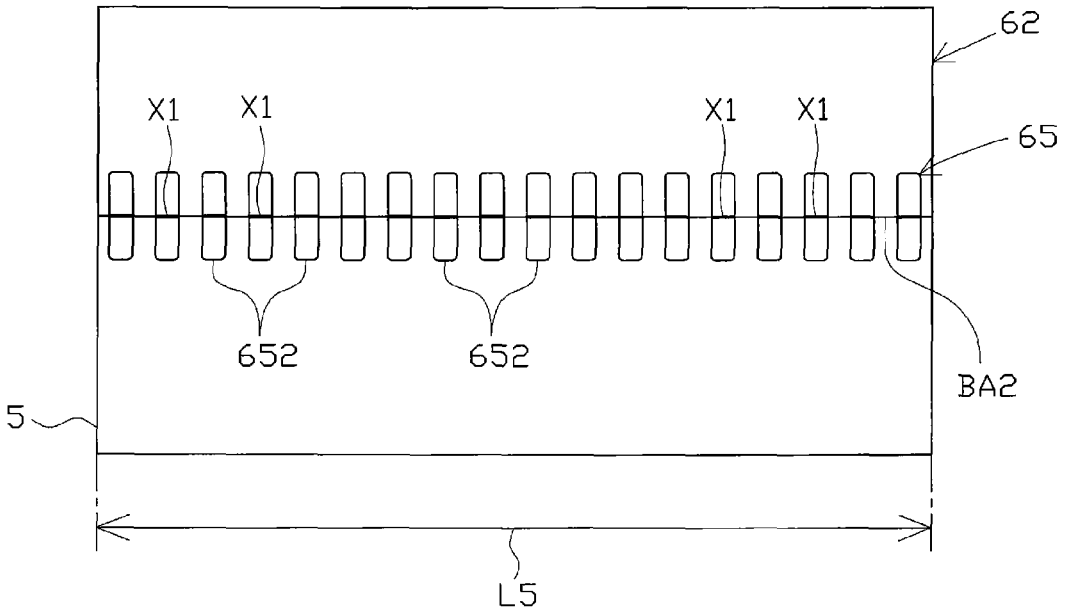
FIG. 39 Development view of outer circumferential surfaces of a center electrode, a fusion zone, etc.

Furthermore, as shown in FIGS. 38 and 39 (FIG. 38 is a sectional view taken along line J-J of FIG. 37 with only the segmental fusion zones 652 being hatched, and FIG. 39 is a development view of outer circumferential surfaces of the center electrode 5, the noble metal tip 62, etc. of FIG. 37), the total length of outer surfaces of those portions X1 (portions represented by bold lines in FIGS. 38 and 39) of the segmental fusion zones 65 which are located on the boundary BA2 between the noble metal tip 62 and the center electrode 5 (i.e., the length of a portion of the fusion zone 65 located on the boundary BA2) is 30% or more (more preferably, 50% or more) of a length L5 of the boundary BA2.

Figure 40:
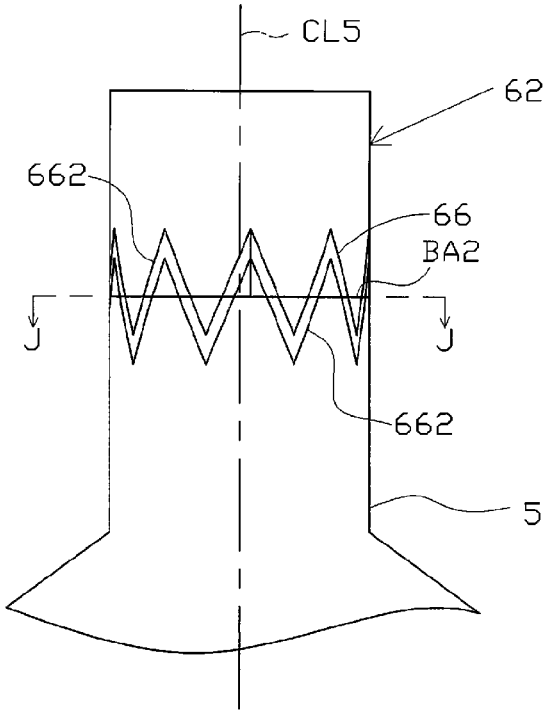
FIG. 40 Fragmentary, enlarged, front view showing another example of the second fusion zone.
Figure 41:
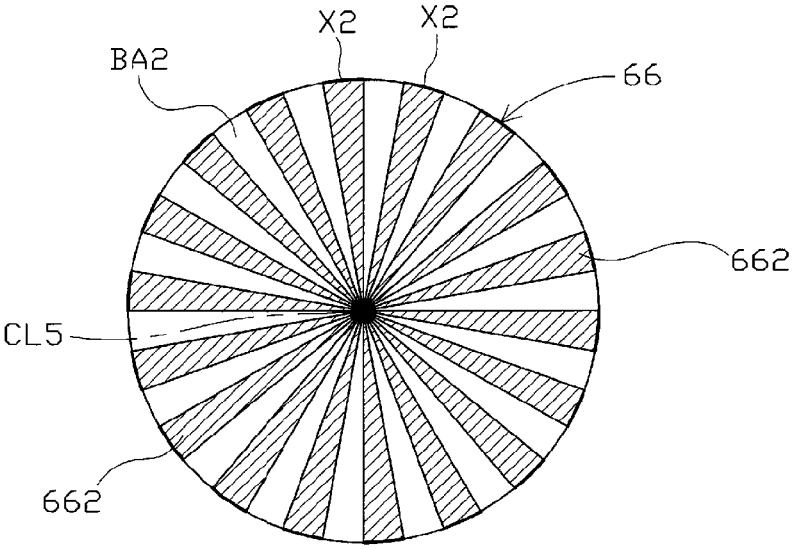
FIG. 41 Sectional view taken along line J-J of FIG. 40.
Figure 42:
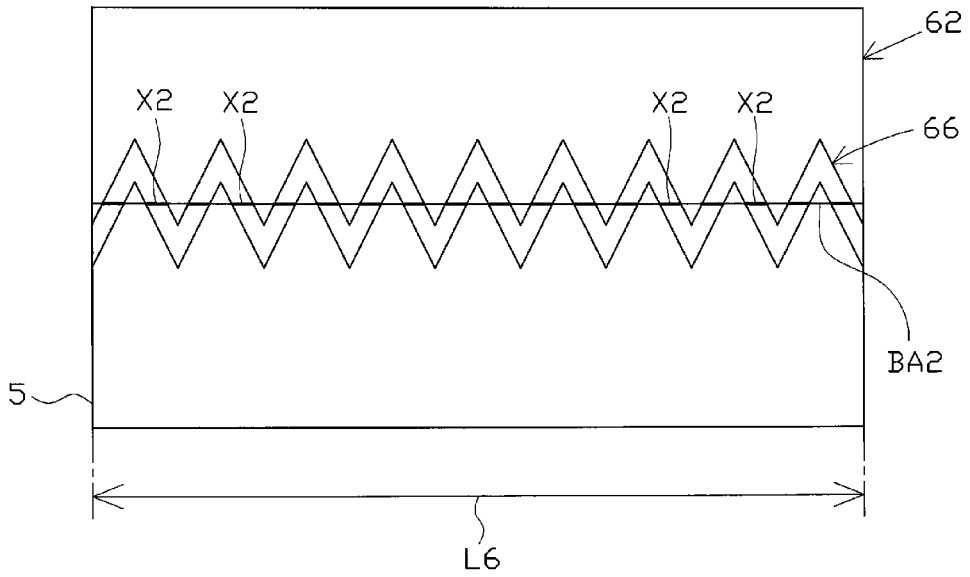
FIG. 42 Development view of outer circumferential surfaces of the center electrode, the fusion zone, etc.

As shown in FIG. 40, a fusion zone 66 may be formed of a plurality of segmental fusion zones 662 which are formed continuously, by wavily radiating the laser beam or the like to the boundary BA2 between the noble metal tip 62 and the center electrode 5 instead of intermittently radiating the laser beam or the like. Also, in this case, as shown in FIGS. 41 and 42 (FIG. 41 is a sectional view taken along line J-J of FIG. 40 with only the segmental fusion zones 662 being hatched, and FIG. 42 is a development view of outer circumferential surfaces of the center electrode 5, the noble metal tip 62, etc. of FIG. 40), the total length of outer surfaces of those portions X2 (portions represented by bold lines in FIGS. 41 and 42) of the fusion zone 66 which are located on the boundary BA2 between the noble metal tip 62 and the center electrode 5 is 30% or more (more preferably, 50% or more, far more preferably 70% or more) of a length L6 of the boundary BA2.

Figure 43:
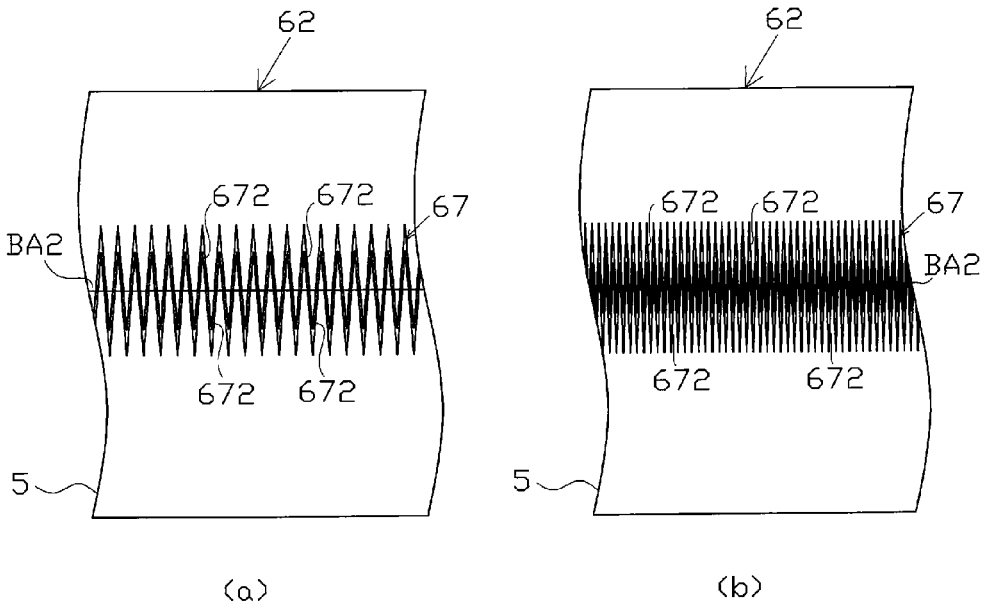
FIGS. 43(*a*) and 43(*b*) Development views of outer circumferential surfaces of the center electrode, the fusion zone, etc., showing a further example of the fusion zone.

Furthermore, as shown in FIGS. 43(*a*) and 43(*b*), a fusion zone 67 may be formed such that segmental fusion zones 672 are disposed at reduced intervals as measured on the boundary BA2 along the circumferential direction of the noble metal tip 62.

Figure 44:
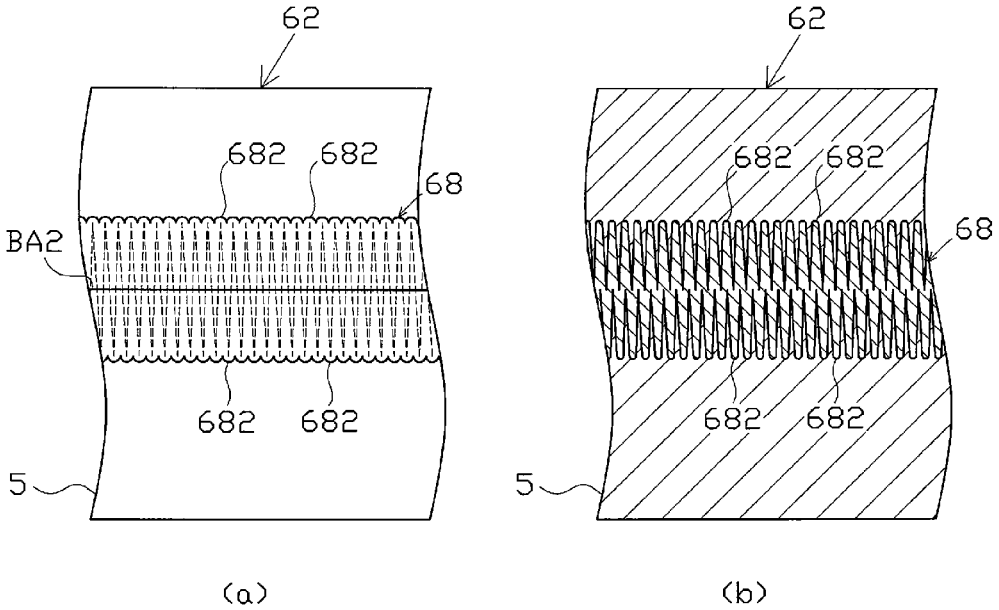
FIG. 44(*a*) Development view of outer circumferential surfaces of the center electrode, the fusion zone, etc., showing a still further example of the fusion zone.

Also, as shown in FIG. 44(*a*) [the dotted line in FIG. 44(*a*) indicates the path of movement of the position of radiation of the laser beam or the like], a fusion zone 68 may be formed such that adjacent segmental fusion zones 682 overlap each other at least on the boundary BA2. In this case, since the segmental fusion zones 682 narrow in a radially inward direction, as viewed on a section of the tip 62 taken in parallel with the center axis CL5, the fusion zone 68 located radially inward (located toward the center axis CL5 of the tip 62) assumes a wavy form as shown in FIG. 44(*b*); thus, it can be confirmed that the laser beam or the like has been wavily radiated.

According to the fourth embodiment, by virtue of the segmental fusion zones 652, there can be restrained movement of the noble metal tip 62 in relation to the center electrode 5 associated with a stress difference which arises between the noble metal tip 62 and the center electrode 5. As a result, strength of joining the noble metal tip 62 can be improved, whereby excellent separation resistance can be implemented.

Also, a portion of the outer surface of the fusion zone 65 located on the boundary BA2 has a length which is 30% or more of a length L6 of the boundary BA2. That is, the segmental fusion zones 652 are formed over a relatively wide range of a boundary region between a circumferential portion of the noble metal tip 62 and the center electrode 5, the boundary region being where a particularly large stress difference arises. Therefore, the segmental fusion zones 652 can more effectively exhibit the wedge function, whereby separation resistance can be more improved.

Furthermore, in the case where the segmental fusion zones 672 are disposed at reduced intervals as measured on the boundary BA2, the fusion zone 67 can effectively absorb a stress difference between the noble metal tip 62 and the center electrode 5 associated with thermal expansion, whereby separation resistance can be far more greatly improved.

Next, in order to verify actions and effects to be yielded by the above embodiments, there were manufactured spark plug samples 1 to 7 serving as examples, and a spark plug sample 8 serving as a comparative example, 30 pieces each, in which the noble metal tips were welded to the respective ground electrodes by use of a fiber laser beam having a spot diameter of 0.03 mm. The samples were subjected to a separation-resistance evaluation test. The separation-resistance evaluation test is briefly described below. The test conducted 1,000 cycles of heating/cooling on the samples in the atmosphere, each cycle consisting of heating by a burner for two minutes such that the noble metal tips had a temperature of 1,100° C., and subsequent cooling such that the noble metal tips were maintained at 200° C. for one minute. After completion of 1,000 test cycles, a portion of one end surface of each of the noble metal tips which was separated from the corresponding ground electrode was measured in area; there was counted the number of those samples in which the area of the separated portion was 50% or less of the area of the one end surface of the noble metal tip (quantity of nondefectives); and the percentage of the quantity of nondefectives to 30 pieces (percentage of nondefectives) was calculated. In the samples, the ground electrodes were formed from INCONEL (registered trademark) 600, and the noble metal tips were formed from an Ir-10Pt alloy. The employed noble metal tips had a square parallelepiped shape such that their one end surfaces measured 1.6 mm×1.6 mm before welding (i.e., the employed noble metal tips had a relatively large cross-sectional area), so as to generate a relatively large stress difference between the noble metal tips and the ground electrodes in association with thermal expansion.

Furthermore, the samples 1 to 8 were configured as follows. The sample 1 was configured as follows: the fiber laser beam is radiated from the side toward the distal end surface of the ground electrode (the same also applies to the samples 2 to 5), and, assuming that the fusion zone is equally divided into three segmental regions along the width direction of the noble metal tip, the first fusion zone and the second fusion zone are in contact with each other only in one of the opposite end ones of the three segmental regions (i.e., configured similar to FIG. 6). The sample 2 was configured such that the first fusion zone and the second fusion zone were in contact with each other only in the center one of the three segmental regions (i.e., configured similar to FIG. 8). The sample 3 was configured such that the first fusion zone and the second fusion zone were in contact with each other in the opposite end ones of the three segmental regions (i.e., configured similar to FIG. 9). The sample 4 was configured such that the first fusion zone and the second fusion zone were in contact with each other in each of the three segmental regions (i.e., configured similar to FIG. 7). The sample 5 was configured such that, while the first fusion zone and the second fusion zone were in contact with each other in the three segmental regions, the number of the second fusion zones was increased to five (i.e., configured similar to FIG. 3). Furthermore, the sample 6 was configured such that, in order to form the fusion zone, in addition to radiation of the fiber laser beam from the side toward the distal end surface of the ground electrode, the fiber laser beam was radiated from a side toward one of the side surfaces of the ground electrode (i.e., configured similar to FIG. 12). The sample 7 was configured such that, in order to form the fusion zone, the fiber laser beam was radiated from the sides toward the opposite side surfaces of the ground electrode (i.e., configured similar to FIG. 11). Notably, the samples 6 and 7 were configured such that, as viewed from the side from which the fiber laser beam had been radiated, the first fusion zone and the second fusion zones were formed similar to those of the sample 5. The sample 8 according to the comparative example was configured such that only the first fusion zone was formed by radiating the fiber laser beam from the side toward the distal end surface of the ground electrode, without provision of the second fusion zone.

Table 1 shows the results of the above-mentioned test.

TABLE 1

| | Percentage of nondefectives (%) | Quantity of nondefectives |
|---|---|---|
| Sample 1 | 43 | 13 |
| Sample 2 | 53 | 16 |
| Sample 3 | 60 | 18 |
| Sample 4 | 73 | 22 |
| Sample 5 | 87 | 26 |
| Sample 6 | 97 | 29 |
| Sample 7 | 100 | 30 |
| Sample 8 | 7 | 2 |

As is apparent from Table 1, as compared with the sample 8 serving as a comparative example, the samples 1 to 7 serving as examples have superior separation resistance. Conceivably, this is for the following reason or the like: by virtue of provision of the second fusion zone, a relatively large stress difference which arose between the noble metal tip and the ground electrode and was difficult for the first fusion zone to absorb alone was able to be sufficiently absorbed.

Also, the following was found out: the sample in which the first fusion zone and the second fusion zone are in contact with each other in the center one of the three segmental regions (sample 2) has more superior separation resistance, and the sample in which the first fusion zone and the second fusion zone are in contact with each other in the opposite end ones of the three segmental regions (sample 3) has far more superior separation resistance. Conceivably, this is for the following reason or the like: by virtue of provision of the second fusion zone in the central segmental region or the opposite end segmental regions, a stress difference which the first fusion zone failed to absorb was able to be effectively absorbed.

Additionally, the following was confirmed: the samples in which the first fusion zone and the second fusion zone are in contact with each other in each of the three segmental regions (samples 4 and 5), and the samples in which the fusion zone is formed by radiating the fiber laser beam from the sides toward at least two of the distal end surface and the opposite side surfaces of the ground electrode (samples 6 and 7), have quite superior separation resistance.

From the above-mentioned test results, in order to improve separation resistance, preferably, the fusion zone is composed of the first fusion zone and the second fusion zone(s), which intersects with the first fusion zone.

Also, in view of further improvement of separation resistance, more preferably, the first fusion zone and the second fusion zone are in contact with each other in the center one or the opposite end ones of the three segmental regions, and, far more preferably, the first fusion zone and the second fusion zone are in contact with each other in each of the three segmental regions.

Furthermore, in view of far more improvement of separation resistance, desirably, the fusion zone is formed by radiating the laser beam or the like from the sides toward at least two of the distal end surface and the opposite side surfaces of the ground electrode.

Next, there were manufactured spark plug samples 11 to 15 serving as examples, and a spark plug sample 16 serving as a comparative example, 30 pieces each, in which the noble metal tips were welded to the respective center electrodes by use of a fiber laser beam having a spot diameter of 0.03 mm. The samples were subjected to the above-mentioned separation-resistance evaluation test. In this test, one cycle consisted of heating by a burner for two minutes such that the noble metal tips had a temperature of 1,000° C., and subsequent cooling such that the noble metal tips were maintained at 200° C. for one minute. The center electrodes were formed from INCONEL 600, and the employed noble metal tips were formed from an Ir-5Rh alloy and had a circular columnar shape having an outside diameter of 1.0 mm.

The samples 11 to 16 were configured as follows. In each of the samples 11 to 16, while the center electrode and the noble metal tip were rotated about the axis, the fiber laser beam was radiated to a boundary region therebetween, thereby forming the first fusion zone along the entire circumference of the noble metal tip. Additionally, in the sample 11, only a single second fusion zone intersecting with the first fusion zone was provided (i.e., configured similar to FIG. 22). In the sample 12, two second fusion zones intersecting with the first fusion zone were provided (i.e., configured similar to FIG. 24). In the sample 13, the second fusion zones were provided at symmetrical positions with respect to the center axis of the noble metal tip (i.e., configured similar to FIG. 21). Additionally, in the sample 14, three second fusion zones were provided (i.e., configured similar to FIG. 23). The sample 15 was configured as follows: when the second fusion zones and the noble metal tip are viewed from the side toward the other end surface of the noble metal tip, the second fusion zones are located at symmetrical positions with respect to the center axis of the noble metal tip, and, assuming that the outer circumferential surface of the fusion zone is equally divided along its circumferential direction into three segmental regions, the second fusion zone is present in each of the three segmental regions (i.e., configured similar to FIG. 26). Also, in the sample 16 serving as a comparative example, only the first fusion zone was formed without provision of the second fusion zone.

Table 2 shows the results of the above-mentioned test.

TABLE 2

| | Percentage of nondefectives (%) | Quantity of nondefectives |
|---|---|---|
| Sample 11 | 50 | 15 |
| Sample 12 | 53 | 16 |
| Sample 13 | 80 | 24 |

TABLE 2-continued

| | Percentage of nondefectives (%) | Quantity of nondefectives |
|---|---|---|
| Sample 14 | 83 | 25 |
| Sample 15 | 97 | 29 |
| Sample 16 | 20 | 6 |

As is apparent from Table 2, as compared with the sample 16 serving as a comparative example, the samples 11 to 15 serving as examples have superior separation resistance.

Also, it was confirmed that provision of a plurality of the second fusion zones further improved separation resistance. In this connection, the following was found out: the sample in which the second fusion zones are provided symmetrically with respect to the center axis of the noble metal tip (sample 13), and the sample in which the second fusion zone is present in each of the three segmental regions (sample 15), are far more superior in separation resistance to the samples in which the same number of the second fusion zones are provided (samples 12 and 14). Conceivably, this is for the following reason: since the second fusion zones were provided at symmetrical positions or the like with respect to the center axis of the noble metal tip, a stress difference was evenly applied to thick portions of the fusion zone (portions where the second fusion zones are present); as a result, the stress difference was able to be more effectively absorbed.

From the above-mentioned test results, similar to the case of joining the noble metal tip to the ground electrode, also in the case of joining the noble metal tip to the center electrode, in order to improve separation resistance of the noble metal tip, preferably, the fusion zone is composed of the first fusion zone and the second fusion zone(s), which intersects with the first fusion zone.

Also, in order to further improve separation resistance, more preferably, as viewed from the side toward the other end surface of the noble metal tip, the second fusion zones are formed at symmetrical positions with respect to the center axis of the noble metal tip, or in such a manner as to be present in the respective ones of the three segmental regions.

Next, in order to verify actions and effects to be yielded by the above third and fourth embodiments, there were manufactured spark plug samples 21 to 25 serving as examples, and a spark plug sample 26 serving as a comparative example, 20 pieces each, in which the noble metal tips were welded to the respective center electrodes by use of a fiber laser beam. The samples were subjected to 1,000 cycles of a heating and cooling test, each cycle consisting of heating by a burner for two minutes such that the noble metal tips had a temperature of 1,000° C., and subsequent cooling such that the noble metal tips were maintained at 200° C. for one minute. Subsequently, the samples were subjected to impact which was applied for one hour by use of a JIS-type impact test machine. Then, the samples were checked to see if the noble metal tip was detached from the center electrode, thereby obtaining the number of samples free from detachment of the noble metal tip (tip-detachment-free quantity) with respect to the samples 21 to 25 and the sample 26. In this test, the center electrodes were formed from INCONEL 600, and the employed noble metal tips were formed from an Ir-10Pt alloy and had a circular columnar shape having an outside diameter of 1.0 mm and a height of 0.7 mm. Furthermore, test conditions other than test time (such as amplitude of vibration and the free length of a spring) conformed to the specifications of the impact resistance test described in JIS B8031.

The samples 21 to 25 serving as examples have a plurality of segmental fusion zones which cross the boundary between the center electrode and one end surface of the noble metal tip, and were configured as follows. The sample 21 was configured as follows: a plurality of the segmental fusion zones which extend along the direction of the center axis of the noble metal tip are provided by intermittently radiating the fiber laser beam from the side toward the outer circumference of the center electrode (i.e., configured similar to FIG. 37), and the total length of outer surfaces of those portions of the fusion zone which are located on the boundary between the noble metal tip and the center electrode is 30% of the length of the boundary. The sample 22 was configured as follows: the configuration is similar to that of FIG. 37, and the total length of outer surfaces of those portions of the fusion zone which are located on the boundary is 50% of the length of the boundary. The sample 23 was configured as follows: an externally exposed portion of the fusion zone waves by wavily radiating the fiber laser beam from the side toward the outer circumference of the center electrode (i.e., configured similar to FIG. 40), and the total length of outer surfaces of those portions of the fusion zone which are located on the boundary is 30% of the length of the boundary. The sample 24 was configured as follows: the configuration is similar to that of FIG. 40, and the total length of outer surfaces of those portions of the fusion zone which are located on the boundary is 50% of the length of the boundary. The sample 25 was configured as follows: the equivalent of the first fusion zone is provided by radiating the fiber laser beam to the boundary, and an externally exposed portion of the fusion zone waves by wavily radiating the fiber laser beam in such a manner as to intersect with the equivalent of the first fusion zone (in other words, in such a manner as to cross the boundary between the center electrode and the noble metal tip) (i.e., configured similar to FIG. 30).

Meanwhile, the sample 26 serving as a comparative example was configured as follows: only the equivalent of the first fusion zone is provided by radiating the fiber laser beam along the boundary between the center electrode and the noble metal tip.

Table 3 shows the results of the above-mentioned test.

TABLE 3

| | Tip-detachment-free quantity |
|---|---|
| Sample 21 | 12 |
| Sample 22 | 17 |
| Sample 23 | 13 |
| Sample 24 | 18 |
| Sample 25 | 18 |
| Sample 26 | 4 |

As is apparent from Table 3, the samples having a plurality of segmental fusion zones which cross the boundary between the center electrode and the noble metal tip (samples 21 to 25) exhibit a tip-detachment-free quantity in excess of 10, indicating that the samples have good separation resistance. Conceivably, this is for the following reason: since a plurality of the segmental fusion zones penetrate into both of the center electrode and the noble metal tip, the segmental fusion zones function as, so to speak, wedges, whereby there is restrained movement of the noble metal tip in relation to the center electrode.

Also, the following was confirmed: particularly, the samples in which the total length of outer surfaces of those portions of the fusion zone which are located on the boundary between the noble metal tip and the center electrode is 50% or more of the length of the boundary (samples 22 and 24) have quite superior separation resistance equivalent to that of the sample having the equivalent of the first fusion zone, in addition to the fusion zone (sample 25).

From the above-mentioned test results, in order to improve separation resistance, preferably, the fusion zone includes a plurality of segmental fusion zones which cross the boundary between the center electrode and one end surface of the noble metal tip.

Also, in order to reliably exhibit the effect of improving separation resistance, preferably, the length of outer surfaces of those portions of the fusion zone which are located on the boundary between the noble metal tip and the center electrode is 30% or more of the length of the boundary. Also, in view of further improvement of separation resistance, more preferably, the length of outer surfaces of those portions of the fusion zone which are located on the boundary between the noble metal tip and the center electrode is 50% or more of the length of the boundary.

The above-mentioned test was conducted on the samples in which the noble metal tip was joined to the center electrode. However, it is conceived that, even when a similar test is conducted on spark plug samples in which the noble metal tip is joined to the ground electrode, similar results will be yielded.

The present invention is not limited to the above-described embodiments, but may be embodied, for example, as follows. Of course, applications and modifications other than those exemplified below are also possible.

Figure 45:
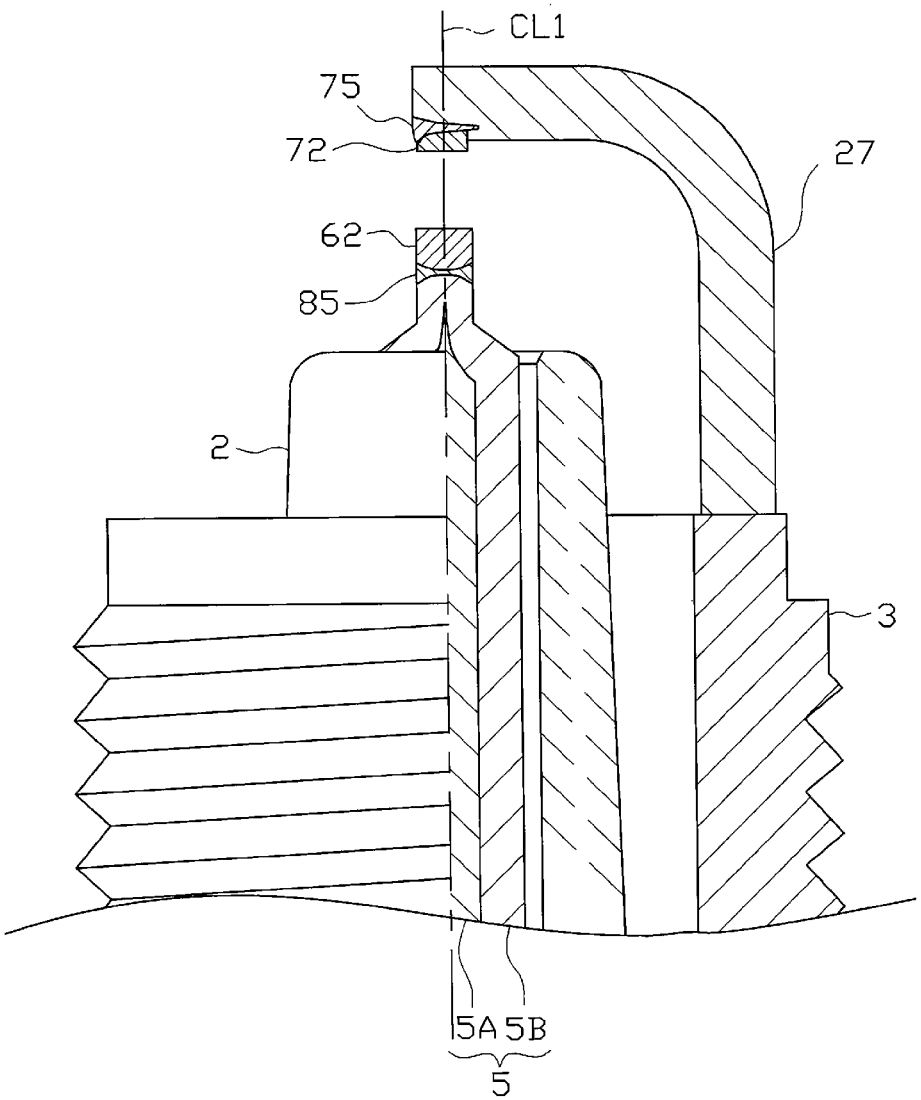
FIG. 45 Partially cutaway, enlarged, front view showing the configuration of a forward end portion of a spark plug according to another embodiment.

(a) In the embodiments described above, the noble metal tip 32 (42, 52, 62) is joined to one of the ground electrode 27 and the center electrode 5 via the fusion zone 35 (45, 55, 65). However, as shown in FIG. 45, noble metal tips 72 and 82 may be joined to the ground electrode 27 and the center electrode 5 via fusion zones 75 and 85, respectively, the fusion zones 75 and 85 having configurations similar to those of the above embodiments. In this case, superior separation resistance can be implemented for both of the noble metal tips 72 and 82.

Figure 46:
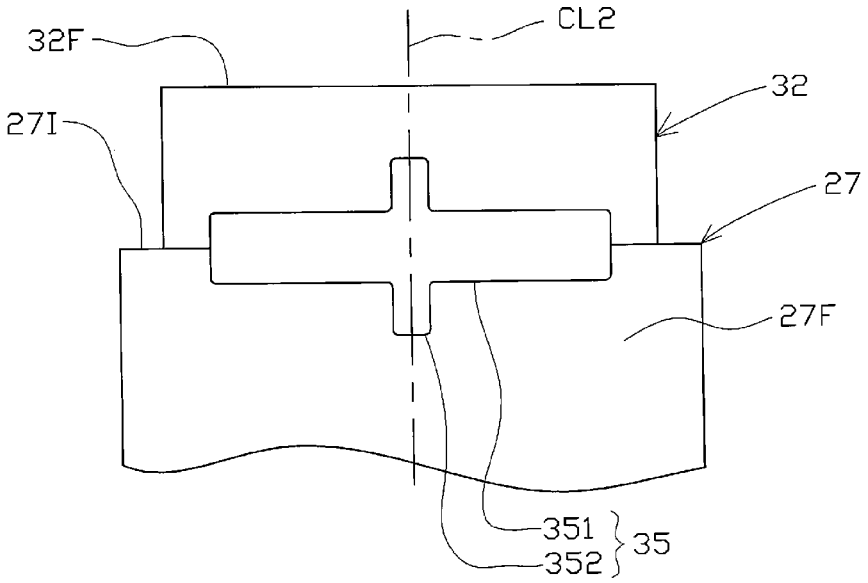
FIG. 46 Fragmentary, enlarged, side view showing the configuration of the fusion zone in a further embodiment.
Figure 47:
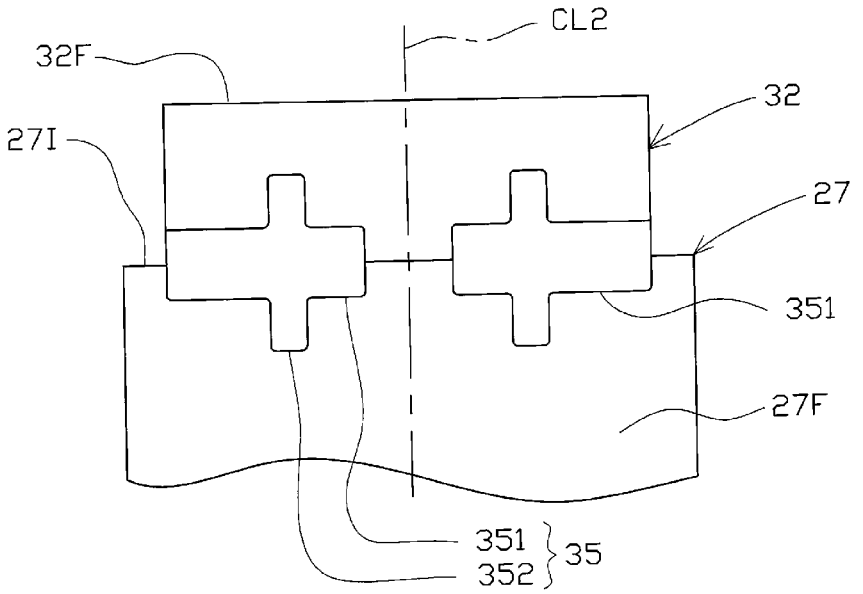
FIG. 47 Fragmentary, enlarged, side view showing the configuration of the fusion zone in a still further embodiment.

(b) In the first embodiment described above, when the noble metal tip 32 and the fusion zone 35 are viewed from the side from which the laser beam or the like has been radiated to the surface of the ground electrode 27, the first fusion zone 351 is formed along the entire width of the noble metal tip 32. However, as shown in FIG. 46, the first fusion zone 351 may be formed such that its width is smaller than that of the noble metal tip 32. Also, instead of the first fusion zone 351 being continuously formed, as shown in FIG. 47, the first fusion zone 351 may be formed intermittently along the perimetrical direction (width direction) of the noble metal tip 32.

Figure 48:
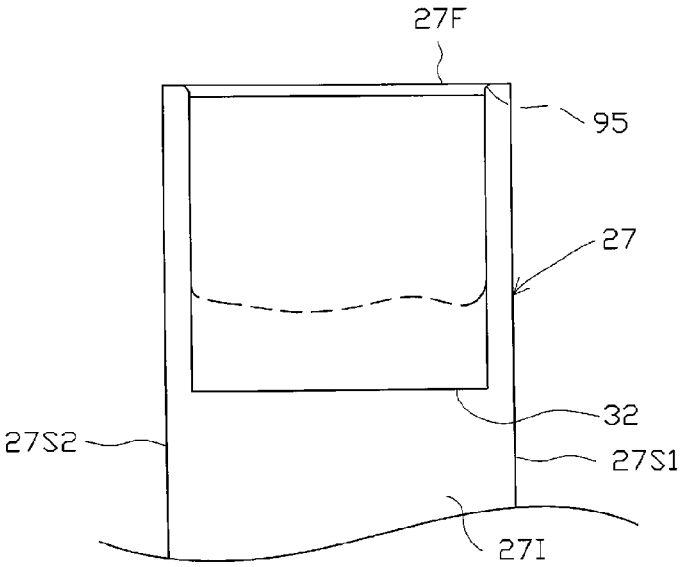
FIG. 48 Fragmentary, enlarged, side view showing the configuration of the fusion zone in yet another embodiment.

(c) In the first embodiment described above, the entire one end surface of the noble metal tip 32 is joined to the ground electrode 27. However, as shown in FIG. 48, a fusion zone 95 may be formed such that a portion of the one end surface of the noble metal tip 32 is joined to the ground electrode 27. Also, in the second embodiment described above, the entire one end surface of the noble metal tip 42 is joined to the center electrode 5; however, a portion of the one end surface of the noble metal tip 42 may be joined to the center electrode 5. However, in order to maintain sufficient joining strength, preferably, half or more of the one end surface of the noble metal tip 32 (42) is joined to the ground electrode 27 (the center electrode 5).

(d) In the first embodiment described above, the length of outer surfaces of the second fusion zones 352 along the perimetrical direction of the noble metal tip 32 is 30% or more of the length of the outer surface of the first fusion zone 351 along the perimetrical direction of the noble metal tip 32. However, in view of further improvement of separation resistance, the length of outer surfaces of the second fusion zones 352 is more preferably 50% or more, far more preferably 70% or more, of the length of the outer surface of the first fusion zone 351.

Also, in the second embodiment described above, the length of outer surfaces of the second fusion zones 452 along the circumferential direction of the noble metal tip 42 is not particularly specified. However, in order to further improve separation resistance, desirably, the length is 30% or more (more preferably 50% or more, far more preferably 70% or more) of the length of the outer surface of the first fusion zone 451 along the circumferential direction of the noble metal tip 42.

Figure 49:
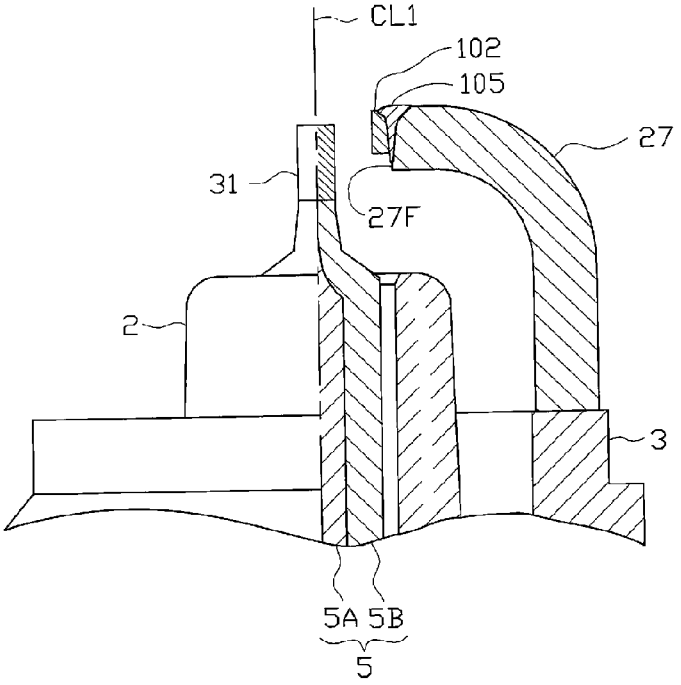
FIG. 49 Partially cutaway, enlarged, front view showing the configuration of a forward end portion of a spark plug according to a further embodiment.

(e) In the first and third embodiments described above, the noble metal tip 32 (52) is joined to the inner side surface 27I of the ground electrode 27. However, as shown in FIG. 49, a noble metal tip 102 may be joined to the distal end surface 27F of the ground electrode 27 via a fusion zone 105.

(f) In the first embodiment described above, the first fusion zone 351 has a maximum thickness $T_{MAX}$ of 0.3 mm or less. However, the first fusion zone 351 may have a maximum thickness $T_{MAX}$ of 0.3 mm or more.

(g) In the embodiments described above, the tool engagement portion 19 has a hexagonal cross section. However, the shape of the tool engagement portion 19 is not limited thereto. For example, the tool engagement portion 19 may have a Bi-HEX (modified dodecagonal) shape [IS022977:2005(E)] or the like.

DESCRIPTION OF REFERENCE NUMERALS

1: spark plug
2: ceramic insulator (insulator)
3: metallic shell
5: center electrode
27: ground electrode
27F: distal end surface (of ground electrode)
27I: inner side surface (of ground electrode)
27S1, 27S2: side surface (of ground electrode)
32, 42, 52, 62: noble metal tip
32F, 42F: other end surface (of noble metal tip)
35, 45, 55, 65: fusion zone
351, 451: first fusion zone
352, 452: second fusion zone
552, 652: segmental fusion zone
CL1: axis
CL2, CL3, CL4, CL5: center axis (of noble metal tip)

The invention claimed is:

1. A spark plug comprising:

a rod like center electrode extending in a direction of an axis;

a tubular insulator provided around the center electrode;

a tubular metallic shell provided around the insulator;

a ground electrode whose proximal end is welded to the metallic shell and whose distal end faces the center electrode; and a columnar noble metal tip formed from a noble metal alloy and provided on at least one object member of the center electrode and the ground electrode;

one end surface of the noble metal tip being joined to the object member via a fusion zone formed through radiation of a laser beam or an electron beam from a side toward a side surface of the noble metal tip;

the spark plug being characterized in that the fusion zone comprises:

a first fusion zone formed through radiation of the laser beam or the electron beam along the entire circumference of a boundary between the object member and the one end surface of the noble metal tip along a perimetrical direction of the noble metal tip, and a second fusion zone formed through radiation of the laser beam or the electron beam from the side from which the laser beam or the electron beam has been radiated in forming the first fusion zone, and intersecting with the first fusion zone; wherein the thickness of the second fusion zone along a longitudinal center axis of the noble metal tip is greater than the thickness of the first fusion zone along the longitudinal center axis of the noble metal tip.

2. The spark plug according to claim 1, wherein the noble metal tip is joined to at least an inner side surface of the ground electrode, and the fusion zone is formed through radiation of the laser beam or the electron beam from a side toward at least one of a distal end surface and opposite side surfaces of the ground electrode, and when the noble metal tip and the fusion zone are viewed from the side from which the laser beam or the electron beam has been radiated to the surface of the ground electrode, assuming that a portion of the fusion zone located between the ground electrode and the noble metal tip is equally divided into three segmental regions along a width direction of the noble metal tip, the first fusion zone and the second fusion zone are in contact with each other in at least a center one of the three segmental regions.

3. The spark plug according to claim 1, wherein the noble metal tip is joined to at least the ground electrode, and the fusion zone is formed through radiation of the laser beam or the electron beam from a side toward at least one of a distal end surface and opposite side surfaces of the ground electrode, and when the noble metal tip and the fusion zone are viewed from the side from which the laser beam or the electron beam has been radiated to the surface of the ground electrode, assuming that a portion of the fusion zone located between the ground electrode and the noble metal tip is equally divided into three segmental regions along a width direction of the noble metal tip, the first fusion zone and the second fusion zone are in contact with each other in at least opposite end ones of the three segmental regions.

4. The spark plug according to claim 1, wherein the noble metal tip is joined to at least the ground electrode, and through radiation of the laser beam or the electron beam from a side toward each of a distal end surface and opposite side surfaces of the ground electrode, the second fusion zone is formed on each of the distal end surface and the opposite side surfaces of the ground electrode.

5. The spark plug according to claim 1, wherein the noble metal tip is joined to at least the ground electrode;

a plurality of the second fusion zones are formed; and as viewed from a side toward the other end surface of the noble metal tip, the second fusion zones are formed at positions located symmetrically with respect to a center axis of the noble metal tip.

6. The spark plug according to claim 1, wherein the noble metal tip is joined to at least the ground electrode;

a plurality of the second fusion zones are formed; and as viewed from a side toward the other end surface of the noble metal tip, the second fusion zones are formed at positions located symmetrically with respect to a straight line which extends along a longitudinal direction of the ground electrode and passes through a center axis of the noble metal tip.

7. The spark plug according to claim 1, wherein the noble metal tip is joined to at least the ground electrode;

a plurality of the second fusion zones are formed; and as viewed from a side toward the other end surface of the noble metal tip, the second fusion zones are formed at positions located symmetrically with respect to a straight line which extends along a direction orthogonal to a longitudinal direction of the ground electrode and passes through a center axis of the noble metal tip.

8. The spark plug according to claim 1, wherein the noble metal tip is joined to at least the center electrode;

the first fusion zone is formed along the entire circumference of the noble metal tip;

a plurality of the second fusion zones are formed; and as viewed from a side toward the other end surface of the noble metal tip, the second fusion zones are formed at positions located symmetrically with respect to a center axis of the noble metal tip.

9. The spark plug according to claim 1, wherein the first fusion zone has a maximum thickness of 0.3 mm or less along a center axis of the noble metal tip.

10. The spark plug according to claim 1, wherein a length of an outer surface of the second fusion zone along a perimetrical direction of the noble metal tip is 30% or more of a length of an outer surface of the first fusion zone along the perimetrical direction of the noble metal tip.

11. The spark plug according to claim 1, wherein a length of an outer surface of the second fusion zone along a perimetrical direction of the noble metal tip is 50% or more of a length of an outer surface of the first fusion zone along the perimetrical direction of the noble metal tip.

12. The spark plug according to claim 1, wherein a length of an outer surface of the second fusion zone along a perimetrical direction of the noble metal tip is 70% or more of a length of an outer surface of the first fusion zone along the perimetrical direction of the noble metal tip.

13. The spark plug according to claim 1, wherein as viewed on a plane of projection which is orthogonal to a center axis of the noble metal tip and on which the noble metal tip and the fusion zone are projected along the center axis, a projected overlap region of the noble metal tip and the fusion zone accounts for 50% or more of a projected region of the noble metal tip.

14. The spark plug according to claim 8, wherein assuming that an outer circumferential surface of the fusion zone is equally divided into three segmental regions along a circumferential direction thereof, the second fusion zone exists in each of the three segmental regions.

15. A spark plug comprising:

a rod like center electrode extending in a direction of an axis;

a tubular insulator provided around the center electrode;

a tubular metallic shell provided around the insulator;

a ground electrode whose proximal end is welded to the metallic shell and whose distal end faces the center electrode; and a columnar noble metal tip formed from a noble metal alloy and provided on at least one object member of the center electrode and the ground electrode;

the spark plug being characterized in that:

one end surface of the noble metal tip is joined to the object member via a fusion zone which, as viewed along the axial direction from the side from which the laser beam or the electron beam has been radiated, has a wave shape formed by radiating a laser beam or an electron beam from a side toward a side surface of the noble metal tip in such a manner as to intersect with a boundary between the noble metal tip and the object member, wherein the wave shape has opposing crests formed on opposite sides of the boundary between the noble metal tip and the object member, the wave shape is substantially sinusoidal, and the fusion zone comprises a plurality of segmental fusion zones formed across the boundary between the object member and the one end surface of the noble metal tip.

16. The spark plug according to claim 15, wherein the noble metal tip is joined to at least an inner side surface of the ground electrode, and the fusion zone is formed through radiation of the laser beam or the electron beam from a side toward at least one of a distal end surface and opposite side surfaces of the ground electrode, and as viewed from the side from which the laser beam or the electron beam has been radiated, a portion of an outer surface of the fusion zone located on a boundary between the noble metal tip and the ground electrode has a length which is 30% or more of a length of the boundary.

17. The spark plug according to claim 15, wherein the noble metal tip is joined to at least an inner side surface of the ground electrode, and the fusion zone is formed through radiation of the laser beam or the electron beam from a side toward at least one of a distal end surface and opposite side surfaces of the ground electrode, and as viewed from the side from which the laser beam or the electron beam has been radiated, a portion of an outer surface of the fusion zone located on a boundary between the noble metal tip and the ground electrode has a length which is 50% or more of a length of the boundary.

18. The spark plug according to claim 15, wherein the noble metal tip is joined to at least the ground electrode, and through radiation of the laser beam or the electron beam from a side toward each of a distal end surface and opposite side surfaces of the ground electrode, the segmental fusion zones are formed on the distal end surface and the opposite side surfaces of the ground electrode.

19. The spark plug according to claim 15, wherein the noble metal tip is joined to at least the ground electrode, and as viewed from a side toward the other end surface of the noble metal tip, the segmental fusion zones are formed at positions located symmetrically with respect to a center axis of the noble metal tip.

20. The spark plug according to claim 15, wherein the noble metal tip is joined to at least the ground electrode, and as viewed from a side toward the other end surface of the noble metal tip, the segmental fusion zones are formed at positions located symmetrically with respect to a straight line which extends along a longitudinal direction of the ground electrode and passes through a center axis of the noble metal tip.

21. The spark plug according to claim 15, wherein the noble metal tip is joined to at least the ground electrode, and as viewed from a side toward the other end surface of the noble metal tip, the segmental fusion zones are formed at positions located symmetrically with respect to a straight line which extends along a direction orthogonal to a longitudinal direction of the ground electrode and passes through a center axis of the noble metal tip.

22. The spark plug according to claim 15, wherein the noble metal tip is joined to at least the center electrode, and a portion of an outer surface of the fusion zone located on a boundary between the noble metal tip and the center electrode has a length which is 30% or more of a length of the boundary.

23. The spark plug according to claim 15, wherein the noble metal tip is joined to at least the center electrode, and a portion of an outer surface of the fusion zone located on a boundary between the noble metal tip and the center electrode has a length which is 50% or more of a length of the boundary.

* * * * *